US011186898B2

(12) United States Patent
Meck et al.

(10) Patent No.: US 11,186,898 B2
(45) Date of Patent: Nov. 30, 2021

(54) CORROSION RESISTANT NICKEL-BASED ALLOYS

(71) Applicant: ATI Properties LLC, Pittsburgh, PA (US)

(72) Inventors: Nacéra Sabrina Meck, Cheswick, PA (US); David S. Bergstrom, Sarver, PA (US); John J. Dunn, Freeport, PA (US); David C. Berry, Washington, PA (US)

(73) Assignee: ATI Properties LLC, Pittsburgh, PA (US)

( * ) Notice: Subject to any disclaimer, the term of this patent is extended or adjusted under 35 U.S.C. 154(b) by 0 days.

(21) Appl. No.: 17/195,511

(22) Filed: Mar. 8, 2021

(65) Prior Publication Data

US 2021/0277501 A1 Sep. 9, 2021

Related U.S. Application Data

(60) Provisional application No. 62/987,154, filed on Mar. 9, 2020.

(51) Int. Cl.
*C22C 19/05* (2006.01)
*C22F 1/10* (2006.01)

(52) U.S. Cl.
CPC ..... *C22C 19/055* (2013.01); *C22F 1/10* (2013.01)

(58) Field of Classification Search
CPC ..... C22C 19/055; C22F 1/10
See application file for complete search history.

(56) References Cited

U.S. PATENT DOCUMENTS

| | | | |
|---|---|---|---|
| 2,777,766 | A | 1/1957 | Binder |
| 3,160,500 | A | 12/1964 | Eiselstein et al. |
| 3,203,792 | A | 8/1965 | Scheil et al. |
| 4,168,188 | A | 9/1979 | Asphahani |
| 4,171,217 | A | 10/1979 | Asphahani et al. |
| 4,400,349 | A | 8/1983 | Kudo et al. |
| 4,410,489 | A | 10/1983 | Asphahani et al. |
| 4,489,040 | A | 12/1984 | Asphahani et al. |
| 4,545,826 | A | 10/1985 | McCann et al. |
| 6,740,291 | B2 | 5/2004 | Crook |
| 9,347,121 | B2 | 5/2016 | Forbes Jones et al. |
| 10,174,397 | B2 | 1/2019 | Rosenberg et al. |
| 2017/0002437 | A1 | 1/2017 | Rosenberg et al. |

FOREIGN PATENT DOCUMENTS

| | | | |
|---|---|---|---|
| EP | 2794949 | A2 | 10/2014 |
| EP | 3070184 | A1 | 9/2016 |
| WO | 2018029305 | | 2/2018 |

OTHER PUBLICATIONS

ATI 904L Technical Data Sheet, Allegheny Technologies Inc., Pittsburgh, PA, Version 1, (Apr. 18, 2012), 5 pages.

"Stainless Steels, Tool Materials and Special-Purpose Metals", Metals Handbook Ninth Edition, vol. 3, Properties and Selection, American Society for Metals, 1980, pp. 143,144, 149-151.

*Primary Examiner* — Jessee R Roe

(74) *Attorney, Agent, or Firm* — Alan G. Towner; Leech Tishman Fuscaldo & Lampl

(57) ABSTRACT

Nickel-based alloys having improved localized corrosion resistance, improved stress-corrosion cracking (SCC) resistance and impact strength are disclosed. The improvements come from the provision of compositions that are resistant to deleterious phase formation and from the addition of alloying elements that improve corrosion resistance, impact strength, and SCC resistance. The nickel-based alloys of the present invention have controlled amounts of Ni, Cr, Fe, Mo, Co, Cu, Mn, C, N, Si, Ti, Nb, Al, and B. When subjected to post-cladding heat treatments or welding, the nickel-based alloys retain their corrosion resistance and possess desirable impact strengths.

27 Claims, 19 Drawing Sheets

Heat 2 as solution annealed

Heat 2 after PCHT

Heat C3 as solution annealed

Heat C3 after PCHT

Solution Annealed

Heat C1

Post-Clad Heat Treatment

Solution Annealed

Heat C2
825

Post-Clad Heat Treatment

Solution Annealed

Heat C4

Post-Clad Heat Treatment

CORROSION RESISTANT NICKEL-BASED ALLOYS

CROSS-REFERENCE TO RELATED APPLICATION

This application claims the benefit of U.S. Provisional Patent Application No. 62/987,154 filed Mar. 9, 2020, which is incorporated herein by reference.

FIELD OF THE INVENTION

The present invention relates to nickel-based alloys having good corrosion resistance, mechanical properties and weldability.

BACKGROUND INFORMATION

The information described in this background section is not necessarily admitted prior art.

Conventional nickel-based alloy 625 (UNS N06625) is one of the most common Ni—Cr materials used in the oil and gas and chemical processing industries because of its excellent corrosion performance. However, alloy 625 is costly. Conventional nickel-based alloy 825 (UNS N08825) is a Ni—Fe—Cr material that is widely used in these industries. Alloy 825 is less expensive than alloy 625, but the corrosion resistance of alloy 825 is substantially lower than that of alloy 625, especially in high chloride aqueous environments where stress corrosion cracking and pitting and crevice corrosion can occur.

There are a number of materials with corrosion resistance properties that are between those of alloy 825 and alloy 625, such as superaustenitic and super-duplex alloys, for example. Such alloys are suitable for many applications, but there are applications for which such alloys are not well suited. Two such applications are hot-roll bonded pipe (HRBP) and bi-metallic process vessels. During the manufacture of these products, a corrosion resistant alloy such as alloy 625 or alloy 825 is bonded or clad to a carbon steel or another substrate material. Depending on the bonding process used, it may be necessary to heat treat the bi-metallic product after welding, cladding, and/or forming. Such post-clad heat treatment (PCHT) is often conducted in a temperature range where carbides, nitrides, and intermetallic phases such as sigma can form. These phases are detrimental to the corrosion resistance and impact strength of most nickel-based alloys and all superaustenitic and super-duplex alloys.

Conventional alloy 625 and alloy 825 are substantially better at maintaining their properties following a PCHT than the superaustenitic and super-duplex alloys, which is why alloy 625 and alloy 825 are the conventional materials of choice for unclad and clad products such as HRBP and bi-metallic process vessels. There are no known commercial alloys that adequately fill the gap between alloy 625 and alloy 825 in the combination of cost, chloride pitting resistance, and SCC performance suitable for clad products such as HRBP and bi-metallic process vessels that require PCHT.

Several alloys, such as those disclosed in U.S. Pat. Nos. 4,545,826 and 10,174,397, have attempted to solve the problem of filling the corrosion resistance gap between alloy 625 and alloy 825 by increasing the Mo, Cr and/or N content with respect to alloy 825 to increase pitting resistance. However, these alloys are still susceptible to corrosion failures such as stress-corrosion cracking (SCC), and can be embrittled during PCHT. Other alloys, such as the alloy disclosed in PCT Application WO 2018/029305, may address the problems of SCC resistance and embrittlement by increasing the Ni to well over 50 percent; however, such high Ni content negates most or all of the cost savings with respect to alloy 625.

SUMMARY OF THE INVENTION

The present invention includes nickel-based alloys having favorable corrosion-resistance properties, including good localized corrosion resistance, stress-corrosion cracking resistance, and intergranular corrosion resistance. The nickel-based alloys also possess favorable mechanical properties and weldability. The improvements come from alloy compositions that are resistant to deleterious phase formation and from the addition of alloying elements that improve corrosion resistance, mechanical properties and weldability. The nickel-based alloys may be subjected to post-cladding heat treatments or welding processes while retaining good corrosion resistance and impact strengths. The nickel-based alloys of the present invention are suitable replacements for alloy 825 and alloy 625 for unclad products and clad products such as HRBP and bi-metallic vessels. The present nickel-based alloys may also be used as replacements for superaustenitic and super-duplex alloys in other applications, especially where phase stability, chloride pitting resistance, and improved SCC resistance are required. The present nickel-based alloys are less costly than alloy 625, have equivalent or better SCC resistance, pitting resistance, crevice, and intergranular corrosion resistance than alloy 825, and are more resistant to degradation of properties following PCHT or other heat treatments, and also higher-temperature fabrication processes such as welding operations, compared to superaustenitic or super-duplex alloys.

An aspect of the present invention provides a nickel-based alloy comprising from 38 to 60 weight percent Ni, from 19 to 25 weight percent Cr, from 15 to 35 weight percent Fe, from 3 to 7 weight percent Mo, and from 0.1 to 10 weight percent Co. The nickel-based alloy possesses at least one of the following properties: a Charpy impact energy of at least 100 ft-lbs, measured using 5-millimeter specimens at −50° C. per ASTM E23-18; a critical pitting temperature of greater than 95° F., measured per ASTM G48 Method C; an intergranular corrosion rate of less than 0.25 mm/yr, measured per ASTM G28 Method A; and a resistance to stress corrosion cracking of greater than 1,000 hrs, measured per ASTM G36.

Another aspect of the present invention provides a method of making a nickel-based alloy comprising from 38 to 60 weight percent Ni, from 19 to 25 weight percent Cr, from 15 to 35 weight percent Fe, from 0.1 to 10 weight percent Co, and from 3 to 7 weight percent Mo. The method comprises: homogenizing an ingot of the nickel-based alloy; working the homogenized ingot to form a slab or billet; further hot rolling to form a plate or bar or tubular product; annealing the product; and cooling the annealed product. The nickel-based alloy possesses at least one of the following properties: a Charpy impact energy of at least 100 ft-lbs, measured using 5-millimeter specimens at −50° C. per ASTM E23-18; a critical pitting temperature of greater than 95° F., measured per ASTM G48 Method C; an intergranular corrosion rate of less than 0.25 mm/yr, measured per ASTM G28 Method A; and a resistance to stress corrosion cracking of greater than 1,000 hrs, measured per ASTM G36.

These and other aspects of the present invention will be more apparent from the following description.

BRIEF DESCRIPTION OF THE DRAWINGS

Various features and characteristics of the invention described in this specification may be more thoroughly understood by reference to the accompanying figures, in which.

DETAILED DESCRIPTION

Figure 1:
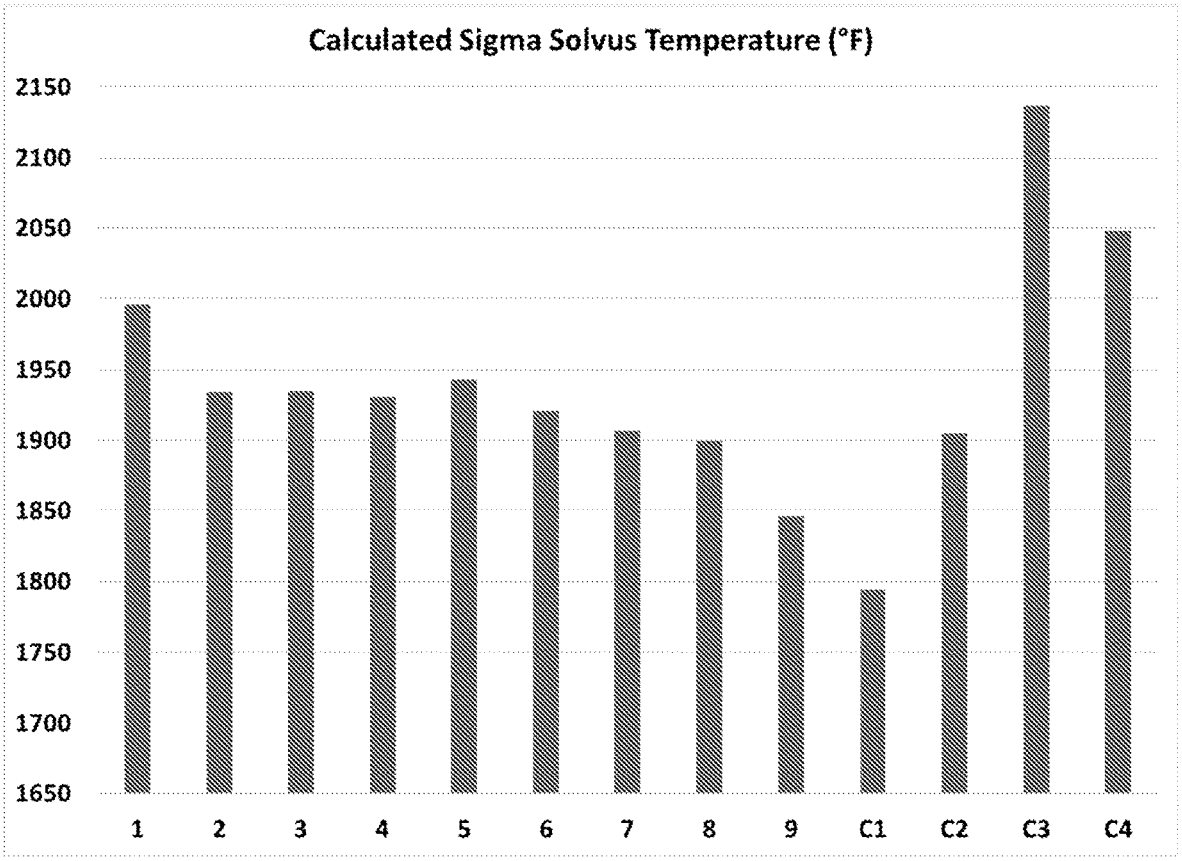
FIG. 1 is a graph of calculated sigma solvus temperatures for various nickel-based alloys of the present invention in comparison with comparative alloys.

The nickel-based alloys of the present invention have controlled amounts of Ni, Cr, Fe, Mo and Co, and may also have controlled amounts of Cu, Mn, C, N, Si, Ti, Nb, B and Al. Such alloying additions may be provided in amounts as shown in Table 1 below. Other elements controlled for technical benefits that improve processing may include V, W, Mg, and rare earth metals. Elements such as P, S, and O, may be present as unavoidable impurities in trace amounts, i.e., such elements are not purposefully added to the present nickel-based alloys. As used herein, "incidental impurities" means elements that are not purposefully added as alloying additions to the nickel-based alloy compositions, but instead are present as unavoidable impurities or in trace amounts. The term "substantially free", when referring to the present alloy compositions, means that an element is only present as an incidental impurity.

TABLE 1

Nickel-Based Alloy Compositional Ranges (wt. %)

| Example | Ni | Cr | Fe | Mo | Co | Cu | Mn | C | N | Si | Ti | Nb | Al | B | V | W | Mg |
|---|---|---|---|---|---|---|---|---|---|---|---|---|---|---|---|---|---|
| A | 38.0-60.0 | 19.0-25.0 | 15.0-35.0 | 3.0-7.0 | 0.1-5.0 | 0.1-4.0 | 0.1-3.0 | ≤0.030 | ≤0.15 | ≤1.0 | ≤0.10 | ≤0.20 | ≤0.30 | ≤0.0050 | ≤0.3 | ≤0.3 | ≤0.01 |
| B | 39.0-50.0 | 20.0-25.0 | 15.0-30.0 | 3.5-6.5 | 0.2-4.0 | 0.2-3.0 | 0.2-2.5 | ≤0.015 | 0.005-0.12 | 0.05-0.50 | 0.01-0.10 | 0.01-0.20 | 0.02-0.30 | 0.0002-0.0050 | ≤0.2 | ≤0.2 | ≤0.01 |

TABLE 1-continued

| Nickel-Based Alloy Compositional Ranges (wt. %) | | | | | | | | | | | | | | | | | |
|---|---|---|---|---|---|---|---|---|---|---|---|---|---|---|---|---|---|
| Example | Ni | Cr | Fe | Mo | Co | Cu | Mn | C | N | Si | Ti | Nb | Al | B | V | W | Mg |
| C | 40.0-48.0 | 21.0-25.0 | 16.0-29.0 | 4.0-6.5 | 0.2-3.0 | 0.25-2.00 | 0.25-2.00 | ≤0.010 | 0.01-0.10 | 0.05-0.40 | 0.01-0.08 | 0.02-0.15 | 0.04-0.25 | 0.0004-0.0035 | ≤0.1 | ≤0.1 | ≤0.01 |
| D | 41.0-48.0 | 22.0-24.0 | 18.0-29.0 | 4.5-6.0 | 0.25-2.60 | 0.25-2.00 | 0.25-1.50 | ≤0.007 | 0.015-0.075 | 0.10-0.40 | 0.01-0.07 | 0.02-0.10 | 0.06-0.25 | 0.0010-0.0030 | ≤0.05 | ≤0.1 | ≤0.01 |

As shown in Table 1, above, the nickel-based alloy of the present invention can comprise, in weight percent, 38.0-60.0 Ni, 19.0-25.0 Cr, 15.0-35.0 Fe, 3.0-7.0 Mo, and 0.1-5.0 Co. The nickel-based alloy can additionally comprise, in weight percent, 0.1-4.0 Cu, 0.1-3.0 Mn, ≤0.030 C, ≤0.15 N, ≤1.0 Si, ≤0.10 Ti, ≤0.20 Nb, ≤0.30 Al, ≤0.0050 B, ≤0.3 V, ≤0.3 W, and ≤0.01 Mg, or any combination of these additional elements. The example compositions shown above in Table 1 are illustrative of possible implementations of the nickel-based alloys of the present invention.

The amounts of Cr, Mo, and N may be selected in order to provide sufficient pitting resistance. The pitting resistance equivalent number (PREN) is calculated according to the formula PREN=% Cr+3.3(% Mo)+16(% N). A higher PREN is associated with better resistance to pitting and crevice corrosion by chlorides. The nickel-based alloy can have a PREN of at least 40, and, in some implementations, at least 41 and up to 45.

The nickel-based alloy can comprise, in weight percent, 38.0-60.0 Ni, or any sub-range subsumed therein, such as, for example, 38.0-55.0, 39.0-50.0, 39.0-49.0, 39.5-50.0, 39.5-49.5, 40.0-50.0, 40.0-49.0, 40.0-48.0, 40.5-49.5, 41.0-48.0, 41.5-48.0, 41.5-47.5, 42.0-48.0, 41.5-46.5, 41.5-46.0, 42.0-46.0, 42.5-48.0, 41.5-45.5, or 41.5-44.0. Ni in an amount of from 38.0 to 60.0 weight percent, and, in some implementations, from 40.0 to 48.0 weight percent, provides stress corrosion cracking resistance, phase stability, good mechanical properties and fabricability. However, the Ni content can be maintained in the range of 40.0-48.0 weight percent, or any sub-range subsumed therein, to reduce nickel content while maintaining material performance. In certain alloys, the Ni content is less than 48.0, or less than 47.0, or less than 46.0, or less than 45.0, or less than 44.0 weight percent. In certain alloys, the nickel content is greater than 38.0, or greater than 38.5, or greater than 39.0, or greater than 39.5, or greater than 40.0, or greater than 40.5, or greater than 41.5, or greater than 42.0, or greater than 42.5 weight percent.

The nickel-based alloy can comprise, in weight percent, 19.0-25.0 Cr, or any sub-range subsumed therein, such as, for example, 20.0-25.0, 21.0-25.0, 22.0-25.0, 20.0-24.0, 21.0-24.0, 22.0-24.0, 20.0-23.0, 21.0-23.0, 22.0-23.0, 21.5-24.5, 21.5-23.5, or 21.5-23.0. Cr in an amount of from 19.0 to 25.0 weight percent, or, in some implementations, from 21.0 to 25.0 weight percent, provides resistance to oxidizing corrosive media and chloride pitting and crevice corrosion. In certain alloys, the Cr content is greater than 19.0, or greater than 19.5, or greater than 20.0, or greater than 20.5, or greater than 21.0, or greater than 21.5, or greater than 22.0 weight percent. As a particular example, the Cr content may be about 22 weight percent when too much Cr is added—for example, above 25.0 weight percent—it can promote the formation of deleterious phases.

The nickel-based alloy can comprise, in weight percent, 3.0-7.0 Mo, or any sub-range subsumed therein, such as, for example, 3.0-6.5, 3.5-6.5, 4.0-6.5, 4.5-6.5, 5.0-6.5, 4.5-6.0, or 5.0-6.0. Mo in an amount of from 3.0-7.0 weight percent, or, in some implementations, from 4.0 to 6.5 weight percent, provides resistance to non-oxidizing (reducing) corrosive media and chloride-induced pitting and crevice corrosion and stress corrosion cracking. In certain alloys, the Mo content is less than 7.0, or less than 6.5, or less than 6.0, or less than 5.8 weight percent. In a particular example, the Mo content may be about 5.5 weight percent. When too much Mo is added—for example, greater than 7.0 weight percent—it can promote the formation of deleterious phases. Increasing Mo to raise the corrosion resistance may be balanced by other compositional changes to reduce the formation of deleterious phases and ensure that the mechanical properties are not degraded.

The nickel-based alloy can comprise, in weight percent, 0.1-5.0 Co, or any sub-range subsumed therein, such as, for example, 0.1-4.0, 0.1-3.0, 0.10-2.60, 0.24.5, 0.2-4.0, 0.2-3.5, 0.2-3.0, 0.20-2.60, 0.25-3.50, 0.25-3.00, or 0.25-2.60. Co in an amount of from 0.1-5.0 weight percent, or, in some implementations, from 0.25 to 2.60 weight percent, in combination with the amounts of Ni described above, provides increased resistance to stress corrosion cracking (SCC) while delivering desirable impact strength and providing solid-solution strengthening. The Co addition may have a beneficial effect on impact toughness and SCC resistance, and its effectiveness may be enhanced by the other alloying additions described in this specification. In certain alloys, the Co content may be greater than 0.25, or greater than 0.5, or greater than 1.0, or greater than 1.5 weight percent. However, Co is a relatively expensive element, so in some implementations, the Co content can be maintained in the range of 0.1-3.0 weight percent, or any sub-range subsumed therein, such as, for example 0.25-2.60, to control cost while delivering improved material performance.

The nickel-based alloy can comprise, in weight percent, 0.1-4.0 Cu, or any sub-range subsumed therein, such as, for example, 0.2-4.0, 0.2-3.0, 0.2-2.5, 0.2-2.0, or 0.25-2.00. Cu in an amount of from 0.1-4.0 weight percent, or, in some implementations, from 0.2 to 2.0 weight percent, provides corrosion resistance to reducing environments, such as sulfuric acid, and may enhance resistance to cracking in the presence of $H_2S$. However, too much Cu—for example, greater than 4.0 weight percent—is detrimental to hot workability and thermal stability.

The nickel-based alloy can comprise, in weight percent, 0.1-3.0 Mn, or any sub-range subsumed therein, such as, for example, 0.2-3.0, 0.2-2.5, 0.2-2.0, 0.25-2.00, or 0.25-1.50. Mn in an amount of from 0.1-3.0 weight percent, or, in some implementations, from 0.25 to 2.00 weight percent, provides increased N solubility and strength. If too much Mn is added—for example, greater than 3.0 weight percent—the impact strength and resistance to localized corrosion may be reduced.

The nickel-based alloy can comprise, in weight percent, up to 1.0 Si, or any sub-range subsumed therein, such as, for example, up to 0.9, up to 0.75, up to 0.6, up to 0.5, up to 0.4, 0.001-1.0, 0.001-0.9, 0.001-0.75, 0.001-0.6, 0.001-0.5, 0.001-0.4, 0.01-1.0, 0.01-0.50, 0.01-0.40, 0.05-1.0, 0.05-0.50, 0.05-0.40, 0.10-0.50, or 0.10-0.40. Si has the effect of increasing the kinetics of deleterious phase formation and as such should be limited to no more than 1% by weight, or, in some implementations, not more than 0.5% or 0.4% by weight. A small amount of Si is typically present in raw materials and lowering the Si content to less than about 0.05%, while possible, may unnecessarily increase the cost of the alloy.

The nickel-based alloy can comprise, in weight percent, up to 0.15 N, or any sub-range subsumed therein, such as, for example, up to 0.1, up to 0.075, 0.001-0.15, 0.001-0.10, 0.001-0.075, 0.005-0.12, 0.005-0.10, 0.005-0.075, 0.01-0.10, 0.01-0.075, or 0.015-0.075. N in an amount up to 0.15 weight percent, or, in some implementations, of from 0.01 to 0.1 weight percent, provides strength and resistance to chloride-induced pitting and crevice corrosion. Too much N—for example, greater than 0.15 weight percent—can lead to the formation of chromium nitrides, which can be deleterious to corrosion resistance and mechanical properties.

The nickel-based alloy can comprise, in weight percent, up to 0.1 Ti, or any sub-range subsumed therein, such as, for example, 0.01-0.10, 0.01-0.08, 0.01-0.07, 0.01-0.06, 0.01-0.05, or 0.01-0.04. Ti in an amount up to 0.1 weight percent, or, in some implementations, of from 0.01 to 0.07 weight percent, may preferentially react with C impurities to form titanium carbide, which reduces or eliminates reactions between Cr and C that would otherwise produce Cr-depleted zones around chromium carbide particles that cause initiation sites for corrosion.

The nickel-based alloy can comprise, in weight percent, up to 0.2 Nb, or any sub-range subsumed therein, such as, for example, 0.01-0.20, 0.02-0.15, 0.02-0.10, 0.025-0.10, 0.025-0.095, 0.025-0.090, or 0.02-0.09. Nb in an amount up to 0.2 weight percent, or, in some implementations, of from 0.02 to 0.1 weight percent, may preferentially react with C impurities to form niobium carbide, which reduces or eliminates reactions between Cr and C that would otherwise produce Cr-depleted zones around chromium carbide particles that cause initiation sites for corrosion.

The nickel-based alloy can comprise, in weight percent, up to 0.005 B, or any sub-range subsumed therein, such as, for example, 0.0001-0.0050, 0.0002-0.0050, 0.0004-0.0035, 0.0005-0.0050, 0.0009-0.0030, 0.0010-0.0030, or 0.0010-0.0020. B in an amount up to 0.005 weight percent, or, in some implementations, of from 0.001 to 0.003 weight percent provides grain-boundary strengthening that improves hot workability. B above about 0.005 can cause the formation of deleterious boride precipitates.

The nickel-based alloy can comprise, in weight percent, up to 0.030 C, or any sub-range subsumed therein, such as, for example, up to 0.015, up to 0.010, up to 0.007, 0.001-0.030, 0.001-0.015, 0.001-0.007, 0.002-0.007, or 0.003-0.007. C in an amount up to 0.030 weight percent, or, in some implementations, up to 0.015 weight percent, provides strength, but it can also combine with Cr to form deleterious chromium carbide particles at the grain boundaries, which depletes Cr in the surrounding area. This is known as grain boundary sensitization. Lower C will minimize the amount of sensitization that occurs. For this reason it is preferred to keep the C below 0.03%, and more preferred to keep C at no greater than 0.01% by weight.

In some implementations of the invention, the nickel-based alloys are substantially free of Mg. As described above, the term "substantially free" means that Mg is not purposefully added as an alloying addition to the nickel-based alloy and is only present in trace amounts or as an incidental impurity. Such Mg-free alloys may include Ti in an amount as described above to provide resistance to edge cracking during production. In other implementations, small amounts of Mg may be added to the nickel-base alloys, for example, up to 0.01% by weight to improve hot workability. Mg may be added, in weight percent, up to 0.01, or any sub-range subsumed therein, such as, for example, up to 0.005, 0.001-0.01, or 0.001-0.005.

The nickel-based alloy can comprise, in weight percent, up to 0.30 Al, or any sub-range subsumed therein, such as, for example, up to 0.25, up to 0.20, up to 0.15, up to 0.10, 0.01-0.30, 0.01-0.25, 0.01-0.20, 0.01-0.15, 0.01-0.10, 0.02-0.30, 0.03-0.20, 0.04-0.25, 0.04-0.15, 0.05-0.2, 0.05-0.15, 0.06-0.25, or 0.06-0.15. The nickel-based alloy can comprise, in weight percent, up to 0.3 V, or any sub-range subsumed therein, such as, for example, up to 0.2, up to 0.1, or up to 0.05. The nickel-based alloy can comprise, in weight percent, up to 0.3 W, or any sub-range subsumed therein, such as, for example, up to 0.25, up to 0.20, up to 0.15, up to 0.1, 0.001-0.3, 0.001-0.25, 0.001-0.20, 0.001-0.15, or 0.001-0.1.

The balance of the nickel-based alloy composition can comprise iron and incidental impurities. In some implementations, the iron balance can comprise, in weight percent, 15.0-35.0 Fe, or any sub-range subsumed therein, such as, for example, 15.0-30.0, 16.0-29.0, 18.0-29.0, or 18.5-29.0.

The nickel-based alloy of the present invention can be melted and cast using ingot metallurgy operations such as one or more of argon oxygen decarburization (AOD), vacuum oxygen decarburization (VOD), vacuum induction melting (VIM), electroslag refining (ESR), or vacuum arc remelting (VAR), for example. Cast ingots, slabs, or billets of the nickel-based alloys of the present invention may be subjected to homogenization, for example, for 12 to 96 hours, or any sub-range subsumed therein, such as, for example, from 24 to 72 hours, at a temperature of from 2,000 to 2,350° F., or any sub-range subsumed therein, such as, for example from 2,100 to 2,200° F. The homogenized products may then be worked at elevated temperatures, such as forging at a temperature of from 1,600 to 2,300° F., or any sub-range subsumed therein, such as, for example from 1,700 to 2,000° F. The working process may form the alloys into slabs or billets, which may then be re-heated to a temperature of from 2,000 to 2,300° F., or any sub-range subsumed therein, such as, for example from 2,050 to 2,150° F., and hot worked to form mill products such as, for example, plates, sheets, strip, foil, bars, tubulars, forged shapes, or coils having a desired thickness, for example, from 0.001 to 4.0 inch thick, or any sub-range subsumed therein.

After hot working, the nickel-based alloy of the present invention may be subjected to annealing at a selected temperature, for example, from 1,750 to 2,300° F., or any sub-range subsumed therein, such as, for example from 1,800 to 2,150° F.

The annealed plates may be rapidly cooled from the annealing temperature to less than 950° F., for example, at a rate of at least 300° F./min.

In some cases, the annealed material is subsequently subjected to additional heat treatment corresponding to a post-cladding heat treatment (PCHT) conventionally used for hot-roll bonded pipe (HRBP) or bi-metallic process vessels. The PCHT may be carried out at various temperatures, for example, from 1,100 to 1,800° F. In some cases, PCHT may be performed in multiple stages at different temperatures, such as, for example, 1,750° F. for one hour followed by 1,100° F. for 45 minutes.

The nickel-based alloys of the present invention can exhibit improved toughness properties after PCHT compared to certain conventional nickel-based alloys. The toughness of the nickel-based alloys of the present invention can be measured in accordance with ASTM E23-18*: Standard Test Methods for Notched Bar Impact Testing of Metallic Materials*, which is incorporated-by-reference into this specification. After undergoing PCHT, as described above, the nickel-based alloys of the present invention retain at least 85% of their initial toughness in a solution annealed condition, as described above, measured as Charpy impact energy at −50° C. per ASTM E23-18. Described differently, the Charpy impact energies of the nickel-based alloys of the present invention in a PCHT condition, as described above, are no greater than 15% less than the Charpy impact energies of the alloys in a solution annealed condition, as described above, when measured at −50° C. per ASTM E23-18 and in either the longitudinal or transverse direction relative to a hot-rolling or other hot-working direction.

In some cases, after undergoing PCHT, as described above, the nickel-based alloys of the present invention retain at least 86%, 87%, 88%, 89%, 90%, 91%, 92%, 93%, 94%, or 95% of their initial toughness in a solution annealed condition, as described above, measured as Charpy impact energy at −50° C. per ASTM E23-18. Described differently, in some cases, the Charpy impact energies of the nickel-based alloys of the present invention in a PCHT condition, as described above, are no greater than 14%, 13%, 12%, 11%, 10%, 9%, 8%, 7%, 6%, or 5% less than the Charpy impact energies of the alloys in a solution annealed condition, as described above, when measured at −50° C. and in either the longitudinal or transverse direction relative to a hot-rolling or other hot-working direction.

In some cases, the Charpy impact energies of the nickel-based alloys of the present invention in a PCHT condition, as described above, are greater than the Charpy impact energies of the alloys in a solution annealed condition, as described above, when measured at −50° C. and in either the longitudinal or transverse direction relative to a hot-rolling or other hot-working direction. In contrast, certain conventional nickel-based alloys exhibit a decrease in their measured Charpy impact energies upon PCHT of at least 19%, and, in some cases at least 50%, when measured in the longitudinal direction. Described differently, such conventional nickel-based alloys retain less than 81%, and, in some cases less than 50%, of their initial toughness in a solution annealed condition after undergoing PCHT.

The nickel-based alloys of the present invention, after a PCHT as described above, can exhibit 5-millimeter size (sample specimen thickness) Charpy impact energies, measured per ASTM E23-18 and at −50° C., and in either the longitudinal or transverse direction, of at least 100 ft-lbs, and, in some cases, at least 110 ft-lbs, 111 ft-lbs, 113 ft-lbs, 115 ft-lbs, 117 ft-lbs, 119 ft-lbs, 120 ft-lbs, 122 ft-lbs, 123 ft-lbs, 125 ft-lbs, 126 ft-lbs, or 127 ft-lbs.

The nickel-based alloys subjected to PCHT maintain desirable properties, including improved corrosion resistance, while maintaining or improving mechanical properties such as impact strength and fracture toughness. Mechanical tests include Charpy impact tests and tensile tests to measure yield strength (YS), ultimate tensile strength (UTS), percentage elongation (% E), and percentage reduction of area (% RA). Corrosion tests include chloride stress corrosion cracking (SCC), critical pitting temperature (CPT), and intergranular attack (IGA).

The following examples are intended to illustrate features of the present invention, and are not intended to limit the scope of the invention.

Example 1

Nine heats of nickel-based alloys of the present invention and four comparative heats were made, and their microstructures and Charpy impact energy properties were evaluated. In addition, for each heat, calculations were made for Pitting Resistance Equivalent Number (PREN) number (Cr+3.3Mo+16N), sigma solvus temperature, average electron vacancy number (Nv) and average d-electron energy (metal-d). Table 2 below shows the compositions of the nine nickel-based alloy examples of the present invention (Heats 1-9) and the four comparative alloys (Heats C1-C4). Ingots of the inventive and comparative alloy examples were produced using laboratory-scale vacuum induction melting and electroslag refining. The ingots were homogenized and forged from 8-inch to 6-inch diameter at temperatures between 2,000° and 1,700° F. Each 6-inch diameter forging was cut into mults that were about 50 pounds each, then forged into pancakes. The pancakes were cut to slabs, which were reheated and hot rolled to approximately 0.27-inch-thick plates. The hot-rolled plates were each cut into five test panels from each heat.

TABLE 2

| Alloy Compositions (wt. %) | | | | | | | | |
|---|---|---|---|---|---|---|---|---|
| Heat # | 1 | 2 | 3 | 4 | 5 | 6 | 7 | 8 |
| Ni | 42.02 | 42.00 | 41.68 | 41.75 | 43.61 | 43.66 | 43.79 | 45.80 |
| Cr | 22.14 | 22.30 | 22.18 | 22.19 | 22.24 | 22.12 | 22.06 | 22.05 |
| Fe (Bal) | 28.96 | 26.36 | 26.24 | 25.63 | 25.79 | 24.07 | 22.50 | 23.66 |
| Mo | 5.49 | 5.51 | 5.56 | 5.51 | 5.47 | 5.50 | 5.53 | 5.51 |
| Mn | 0.25 | 1.47 | 1.45 | 1.48 | 0.99 | 0.99 | 0.99 | 0.50 |
| Si | 0.29 | 0.28 | 0.28 | 0.29 | 0.33 | 0.33 | 0.33 | 0.34 |
| Cu | 0.25 | 0.25 | 0.25 | 0.24 | 0.25 | 0.97 | 1.96 | 0.25 |
| N | 0.022 | 0.071 | 0.061 | 0.057 | 0.037 | 0.037 | 0.040 | 0.022 |
| W | 0.10 | 0.10 | 0.10 | 0.10 | 0.10 | 0.10 | 0.10 | 0.10 |
| Co | 0.26 | 1.48 | 2.00 | 2.50 | 0.99 | 2.00 | 2.56 | 1.50 |
| Ti | 0.01 | 0.01 | 0.01 | 0.04 | 0.017 | 0.014 | 0.012 | 0.012 |
| B | 0.0011 | 0.0011 | 0.0011 | 0.0011 | 0.0012 | 0.0012 | 0.0012 | 0.0011 |
| P | 0.0141 | 0.0100 | 0.0141 | 0.0156 | 0.0148 | 0.0149 | 0.0150 | 0.0153 |
| S | 0.0005 | 0.0005 | 0.0006 | 0.0006 | 0.0005 | 0.0004 | 0.0005 | 0.0003 |

TABLE 2-continued

| Alloy Compositions (wt. %) | | | | | | | | |
|---|---|---|---|---|---|---|---|---|
| Nb | 0.031 | 0.065 | 0.065 | 0.061 | 0.086 | 0.086 | 0.054 | 0.084 |
| Al | 0.066 | 0.066 | 0.060 | 0.070 | 0.102 | 0.072 | 0.071 | 0.075 |
| C | 0.006 | 0.005 | 0.006 | 0.005 | 0.004 | 0.006 | 0.005 | 0.006 |
| O | 0.002 | 0.002 | 0.001 | 0.002 | 0.003 | 0.002 | 0.003 | 0.003 |
| V | 0.009 | 0.010 | 0.010 | 0.010 | 0.009 | 0.009 | 0.009 | 0.009 |
| PREN | 40.6 | 41.6 | 41.5 | 41.3 | 40.9 | 40.8 | 40.9 | 40.6 |
| Sigma Solvus | 1996° F. | 1934° F. | 1935° F. | 1931° F. | 1943° F. | 1921° F. | 1907° F. | 1900° F. |
| Nv | 2.331 | 2.315 | 2.318 | 2.290 | 2.295 | 2.267 | 2.234 | 2.246 |
| Metal-d | 0.865 | 0.861 | 0.863 | 0.861 | 0.861 | 0.860 | 0.858 | 0.860 |

| Heat # | 9 | 10 | C1 | C2 | C3 | C4 |
|---|---|---|---|---|---|---|
| Ni | 47.89 | 43.48 | 60.65 | 38.90 | 24.4 | 45.23 |
| Cr | 22.04 | 22.00 | 21.66 | 22.07 | 20.29 | 22.26 |
| Fe (Bal) | 18.95 | 24.95 | 4.26 | 31.76 | 47.60 | 20.08 |
| Mo | 5.51 | 5.72 | 8.48 | 3.30 | 6.16 | 8.16 |
| Mn | 0.49 | 0.17 | 0.26 | 0.50 | 0.41 | 0.50 |
| Si | 0.34 | 0.40 | 0.34 | 0.39 | 0.31 | 0.33 |
| Cu | 1.95 | 0.97 | 0.26 | 1.84 | 0.27 | 1.01 |
| N | 0.019 | 0.05 | 0.017 | 0.006 | 0.17 | 0.023 |
| W | 0.10 | 0.066 | 0.15 | 0.13 | 0.10 | 0.10 |
| Co | 2.51 | 2.00 | 0.248 | 0.26 | 0.26 | 2.03 |
| Ti | 0.013 | 0.001 | 0.157 | 0.48 | 0.011 | 0.014 |
| B | 0.0012 | 0.0007 | 0.0015 | 0.0009 | 0.0004 | 0.0012 |
| P | 0.0138 | 0.006 | 0.015 | 0.0124 | 0.012 | 0.0173 |
| S | 0.0005 | 0.0002 | 0.0005 | 0.0005 | 0.0006 | 0.0005 |
| Nb | 0.054 | 0.093 | 3.27 | 0.09 | 0.048 | 0.087 |
| Al | 0.084 | 0.060 | 0.24 | 0.189 | 0.045 | 0.078 |
| C | 0.006 | 0.006 | 0.028 | 0.013 | 0.020 | 0.006 |
| O | 0.004 | — | 0.005 | 0.003 | 0.002 | 0.004 |
| V | 0.010 | 0.029 | 0.009 | 0.009 | 0.010 | 0.011 |
| PREN | 40.5 | 41.7 | 49.9 | 33.1 | 43.3 | 49.6 |
| Sigma Solvus | 1846° F. | 1935° F. | 1794° F. | 1925° F. | 2113° F. | 2048° F. |
| Nv | 2.154 | 2.260 | 1.843 | 2.300 | 2.595 | 2.264 |
| Metal-d | 0.852 | 0.862 | 0.773 | 0.835 | 0.880 | 0.869 |

The heats were solution annealed (SA) at temperatures of about 2,100° F. (1,150° C.) after rolling. Some of the material was also given a simulated post clad heat treatment (PCHT) which consisted of one stage at 1750° F. (954° C.) followed by a second stage at 1100° F. (593° C.). Testing was performed on samples in both the SA and PCHT conditions. Specimens of each heat were used for microstructural analysis and testing Charpy impact energy in both the SA and PCHT conditions.

Table 2 lists the PREN number for each heat and the sigma solvus temperature. The sigma solvus temperature is determined by using the Thermo-Calc thermodynamic calculation software to determine the highest temperature at which sigma phase is thermodynamically stable for each composition. The alloy compositions of the present invention may be optimized to resist formation of deleterious phases during PCHT. Thermo-Calc thermodynamic calculation software and standard equations for average electron vacancy number ($N_Y$) and average d-electron energy (Ma or Metal-d) may be used to calculate phase stability based upon the alloy compositions. The applicable equations for Nv and Md are described in Cieslak et al., "The Use of New PHACOMP in Understanding the Solidification Microstructure of Nickel Base Alloy Weld Metal," *Metallurgical Transactions A*, Vol. 17A (2107-16), December 1986, which is incorporated-by-reference into this specification. The results of the sigma solvus calculations are shown in FIG. 1 in comparison with those of comparative alloys. In general, a lower sigma solvus temperature and lower values of Nv and Metal-d correlate with better phase stability and resistance to deleterious intermetallic phase formation. Lower sigma solvus temperatures indicate less susceptibility to formation of deleterious phases for alloys of the present invention versus certain conventional alloys. This increased phase stability could allow the use of lower solution annealing temperatures, which would make production and fabrication of the alloys simpler and less costly.

The example heats contained varied amounts of Ni, Fe, Mo, Mn, N, Co, Cu, and Nb so that the effect of changing the concentrations of these elements on the corrosion and mechanical properties of the new alloys could be measured.

As shown in Table 2 above, the compositions of Heat Nos. 1-9 include varying amounts of Ni within a range of about 40 to 48 weight percent and alloying additions including Cr within a range of about 21 to 23 weight percent, Mo within a range of about 4.0 to 6.0 weight percent, Co within a range of about 0.25 to 2.6 weight percent, Cu within a range of about 0.25 to 2 weight percent, Mn within a range of about 0.25 to 2.0 weight percent, N within a range of about 0.01 to 0.07 weight percent, Si within a range of up to about 1.0 weight percent, Ti within a range of about 0.01 to 0.05 weight percent, Nb within a range of about 0.02 to 0.1 weight percent, and Al within a range of from 0.06 to 0.25 weight percent, C up to 0.015, B within a range of from 0.001 to 0.003 and the balance is Fe and incidental impurities.

Figure 2:
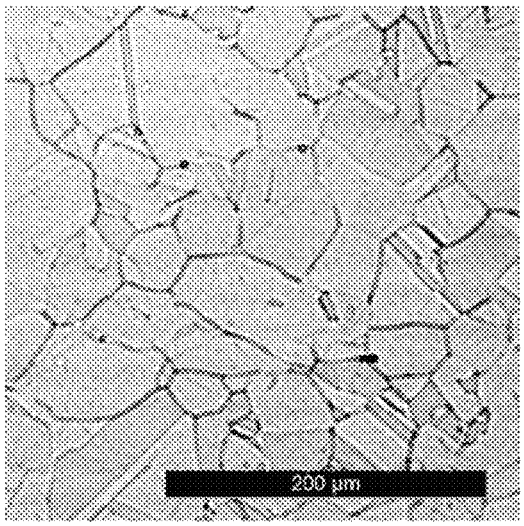
FIGS. 2, 3, 4, and 5 are optical micrographs of a nickel-based alloy (FIGS. 2 and 3) of the present invention in solution annealed and PCHT conditions, respectively, and a comparative alloy (FIGS. 4 and 5) in solution annealed and PCHT conditions, respectively.
Figure 3:
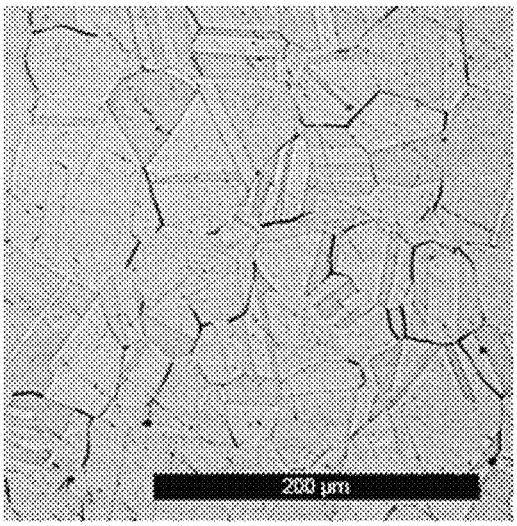
Figure 4:
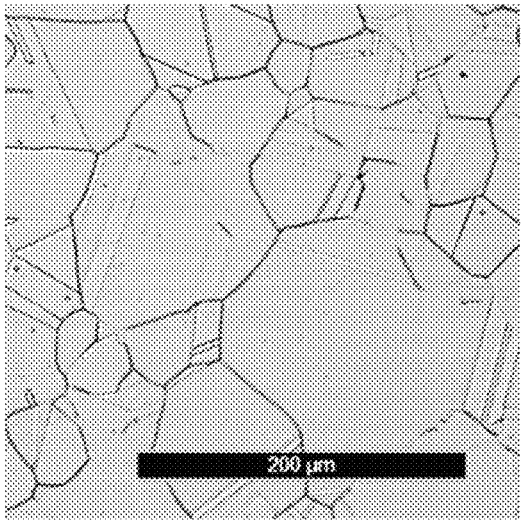
Figure 5:
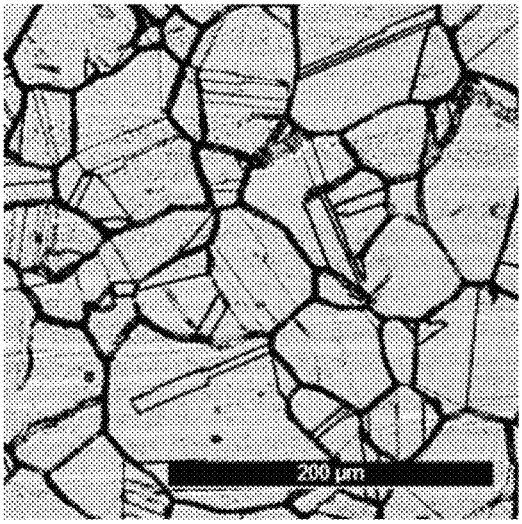

FIGS. 2 and 3 are micrographs of a nickel-based alloy of the present invention (Heat 2) in the solution annealed condition and in the PCHT condition, respectively, and FIGS. 4 and 5 are of a comparative conventional alloy (Heat C3) in the same conditions. All samples were electrolytically etched in oxalic acid using the same etching procedure. The microstructures of both alloys look similar in the solution annealed condition, but, as shown by the dark intergranular regions in FIG. 5, the simulated post-clad heat treatment (PCHT) has caused a much higher quantity of deleterious phases to precipitate on the grain boundaries of the conventional alloy C3, which caused degradation of its mechanical and corrosion properties, as seen in the data presented. This shows that the inventive alloy is better suited for use in applications requiring PCHT.

Figures 6, 7:
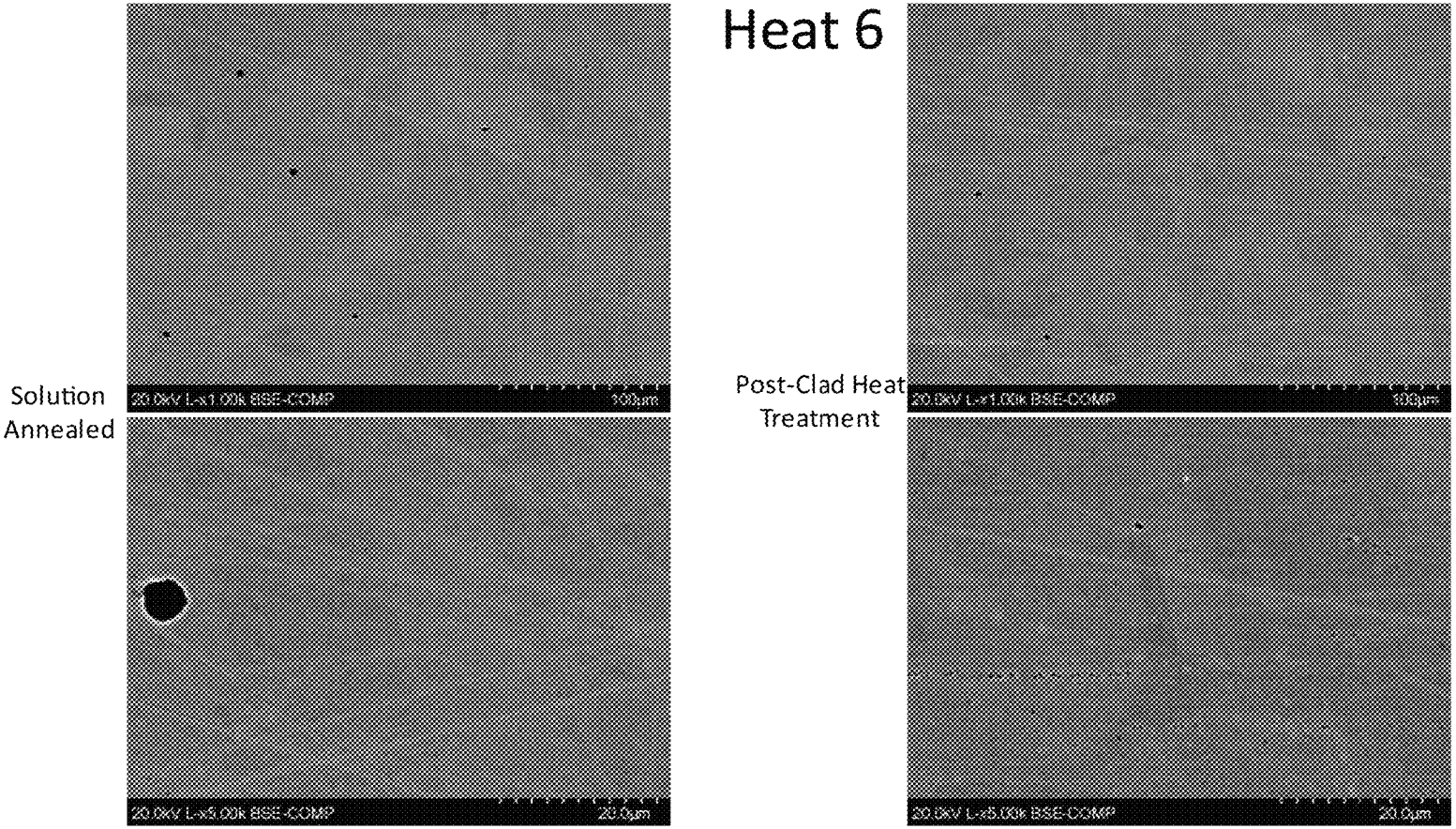
FIGS. 6 and 7 are SEM micrographs of a nickel-based alloy of the present invention in a solution annealed condition (FIG. 6) and in a PCHT condition (FIG. 7). The upper image is taken at a lower magnification than the lower image.

FIGS. 6 and 7 are SEM micrographs of nickel-based alloy Heat #6 of the present invention in the solution annealed condition (FIG. 6) and in the PCHT condition (FIG. 7). The upper image is taken at a lower magnification than the lower image. The microstructures shown in FIGS. 6 and 7 are substantially free of deleterious intergranular phases such as sigma in both the solution annealed and PCHT conditions, thereby significantly reducing the corrosion susceptibility.

Figure 8:
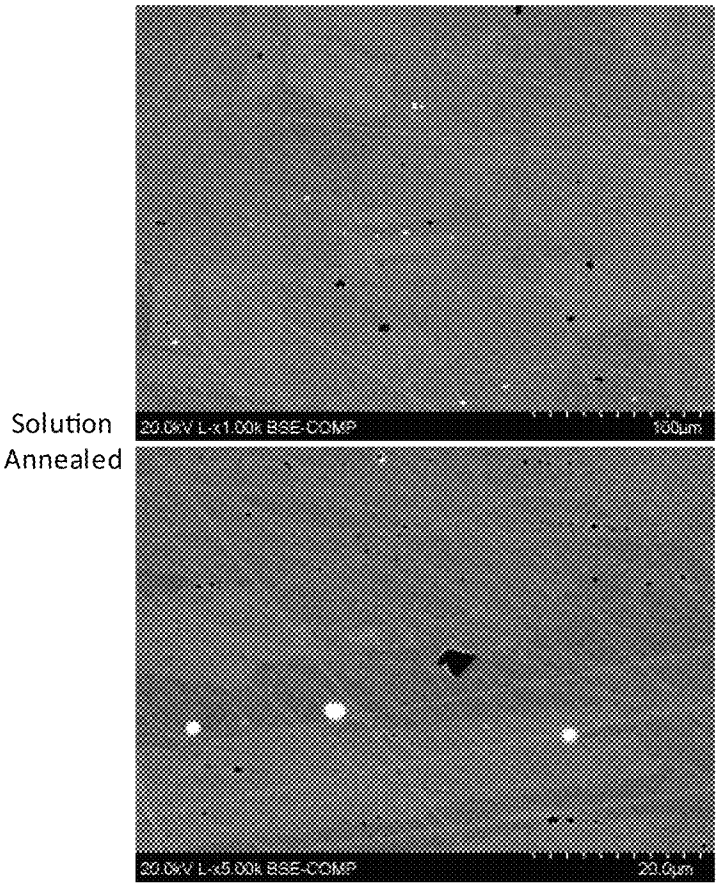
FIGS. 8 and 9 are SEM micrographs of a comparative alloy in a solution annealed condition (FIG. 8) and in a PCHT condition (FIG. 9). The upper image is taken at a lower magnification than the lower image.
Figure 9:
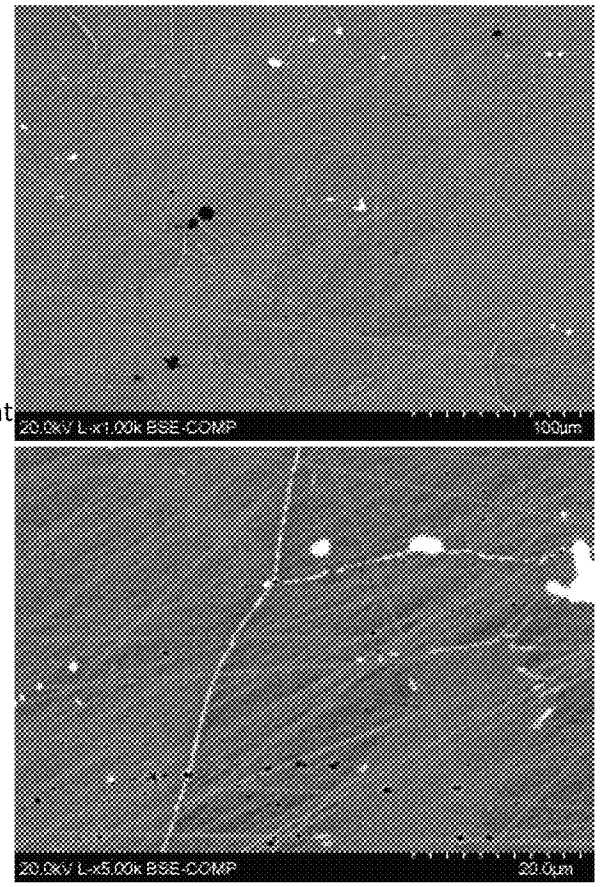

FIGS. 8 and 9 are SEM micrographs of comparative alloy C1 in the solution annealed condition (FIG. 8) and in the PCHT condition (FIG. 9). The upper image is taken at a lower magnification than the lower image. The lighter regions in FIG. 9 correspond to a deleterious phase such as sigma located at grain boundaries. The presence of such an intergranular phase in comparative alloy C1 in the PCHT condition significantly increases intergranular corrosion susceptibility of the alloy.

Figure 10:
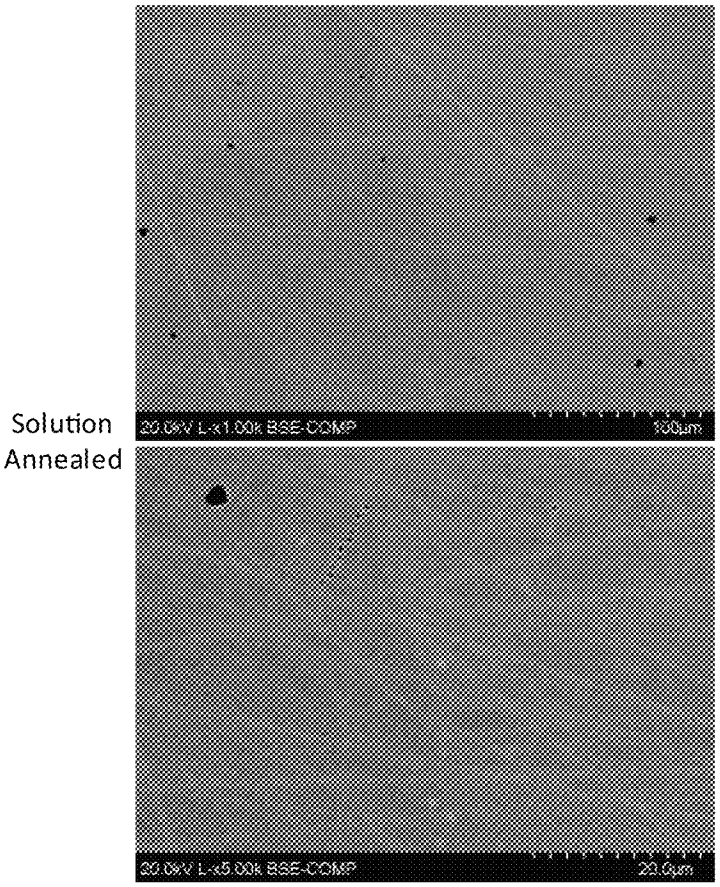
FIGS. 10 and 11 are SEM micrographs of another comparative alloy in a solution annealed condition (FIG. 10) and in a PCHT condition (FIG. 11). The upper image is taken at a lower magnification than the lower image.
Figure 11:
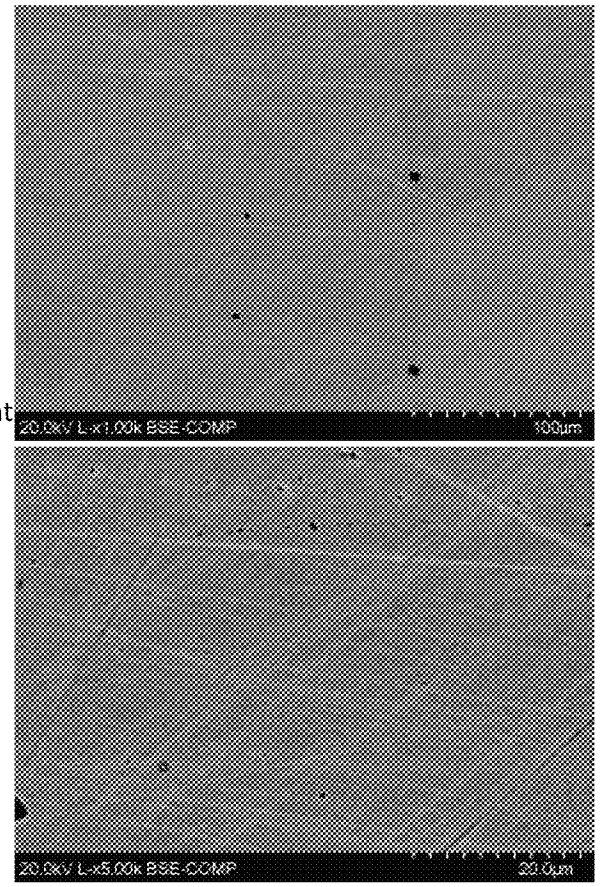

FIGS. 10 and 11 are SEM micrographs of comparative alloy C2 in the solution annealed condition (FIG. 10) and in the PCHT condition (FIG. 11). The upper image is taken at a lower magnification than the lower image.

Figure 12:
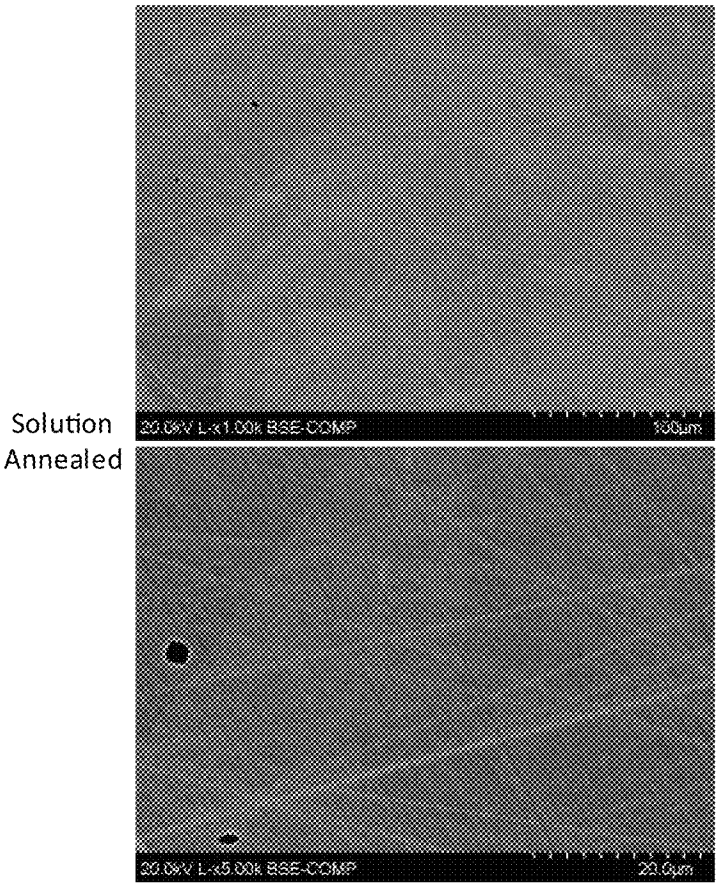
FIGS. 12 and 13 are SEM micrographs of another comparative alloy in a solution annealed condition (FIG. 12) and in a PCHT condition (FIG. 13). The upper image is taken at a lower magnification than the lower image.
Figure 13:
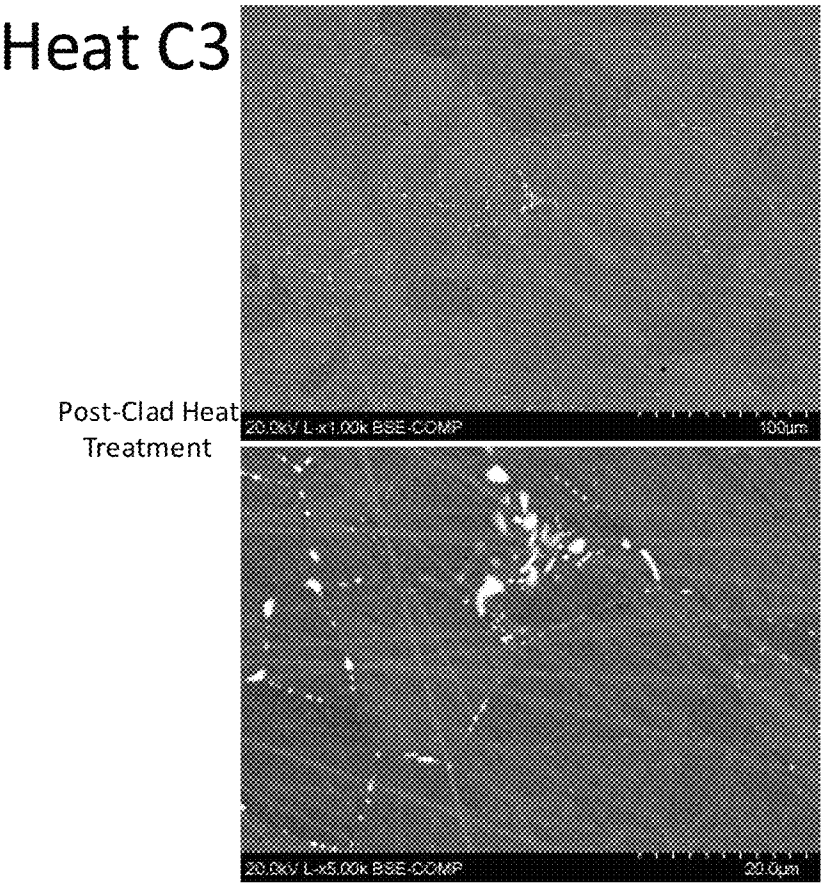

FIGS. 12 and 13 are SEM micrographs of comparative alloy C3 in the solution annealed condition (FIG. 12) and in the PCHT condition (FIG. 13). The upper image is taken at a lower magnification than the lower image. The lighter regions in FIG. 13 correspond to a deleterious phase such as sigma located at grain boundaries. The presence of such an intergranular phase in comparative alloy C3 in the PCHT condition significantly increases intergranular corrosion susceptibility of the alloy.

Figure 14:
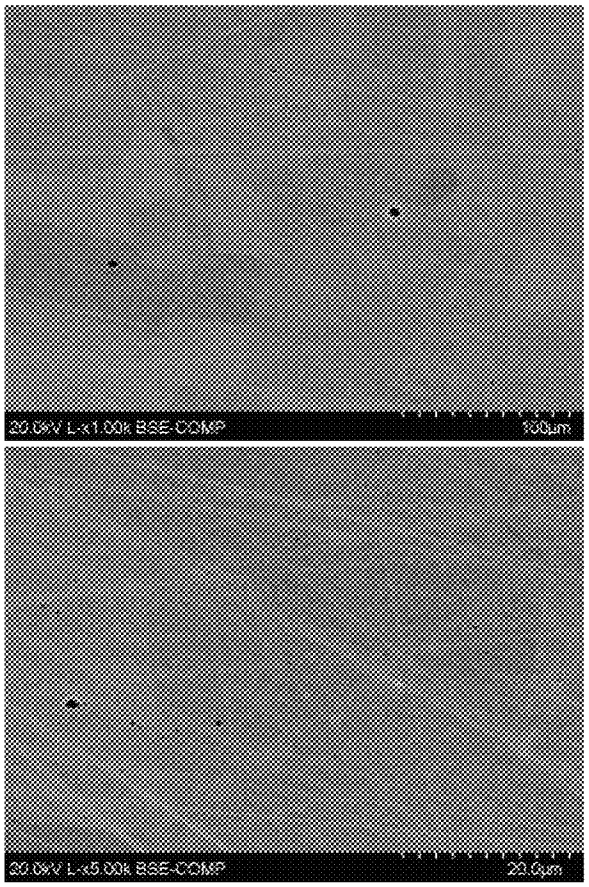
FIGS. 14 and 15 are SEM micrographs of another comparative alloy in a solution annealed condition (FIG. 14) and in a PCHT condition (FIG. 15). The upper image is taken at a lower magnification than the lower image.
Figure 15:
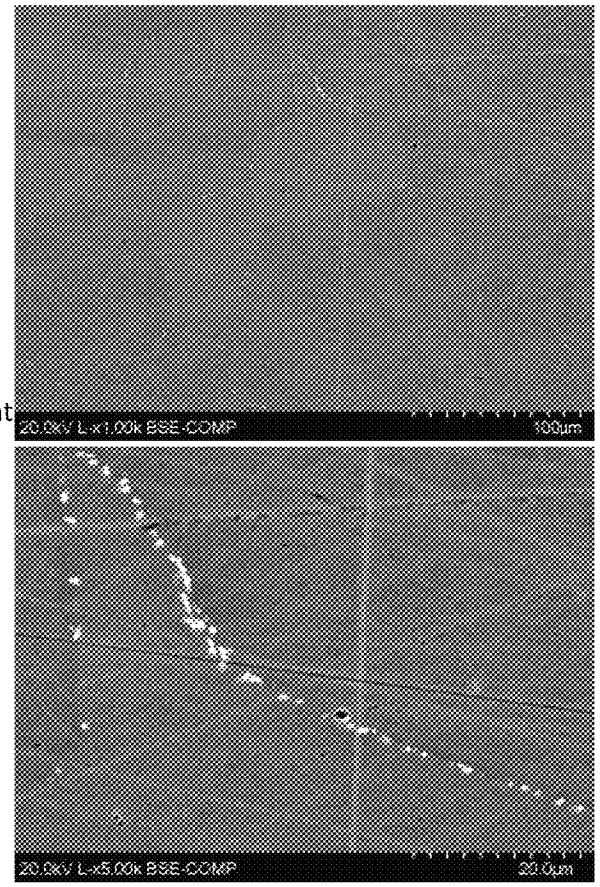

FIGS. 14 and 15 are SEM micrographs of comparative alloy C4 in the solution annealed condition (FIG. 14) and in the PCHT condition (FIG. 15). The upper image is taken at a lower magnification than the lower image. The lighter regions in FIG. 15 correspond to a deleterious phase such as sigma located at grain boundaries. The presence of such an intergranular phase in comparative alloy C4 in the PCHT condition significantly increases intergranular corrosion susceptibility of the alloy.

Figure 16:
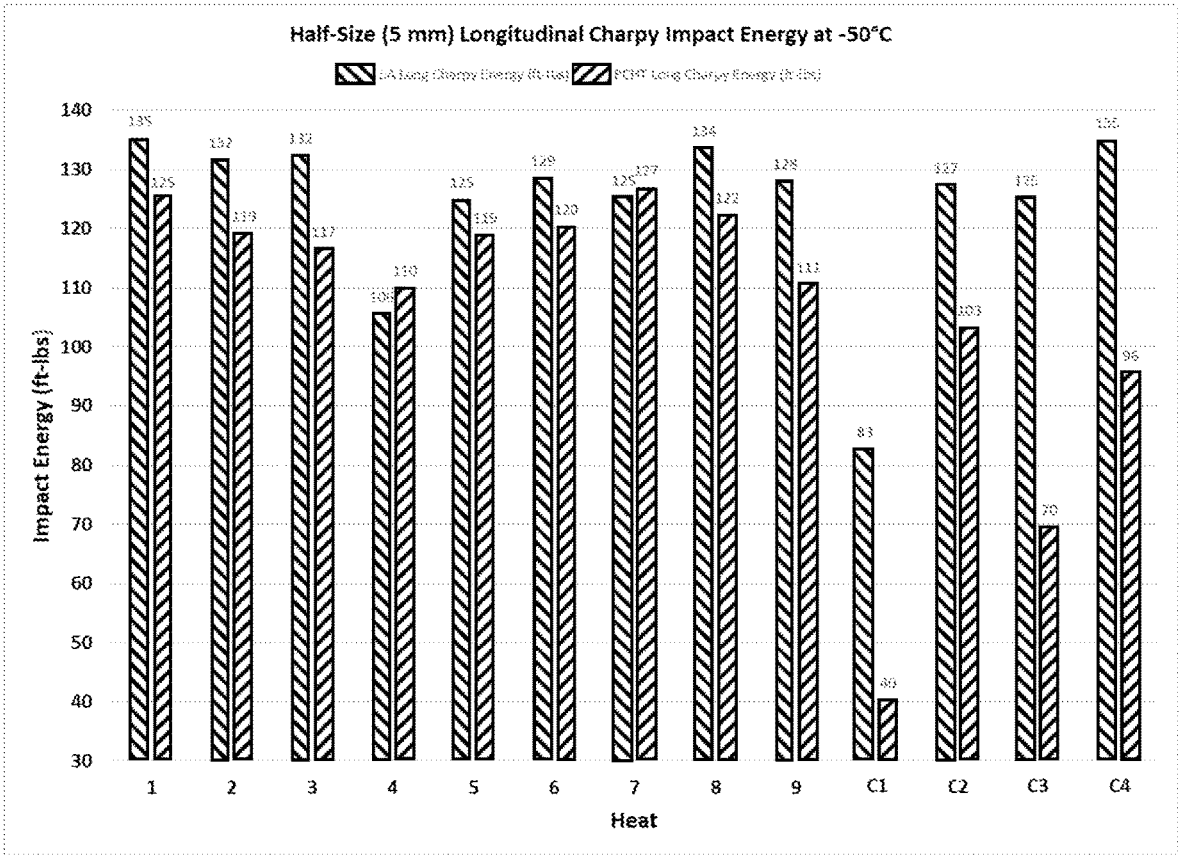
FIG. 16 is a graph of longitudinal Charpy impact energies for various nickel-based alloys of the present invention in comparison with comparative alloys, both without PCHT and with PCHT, indicating less reduction in the impact strengths of the present alloys following PCHT in comparison with certain comparative alloys.
Figure 17:
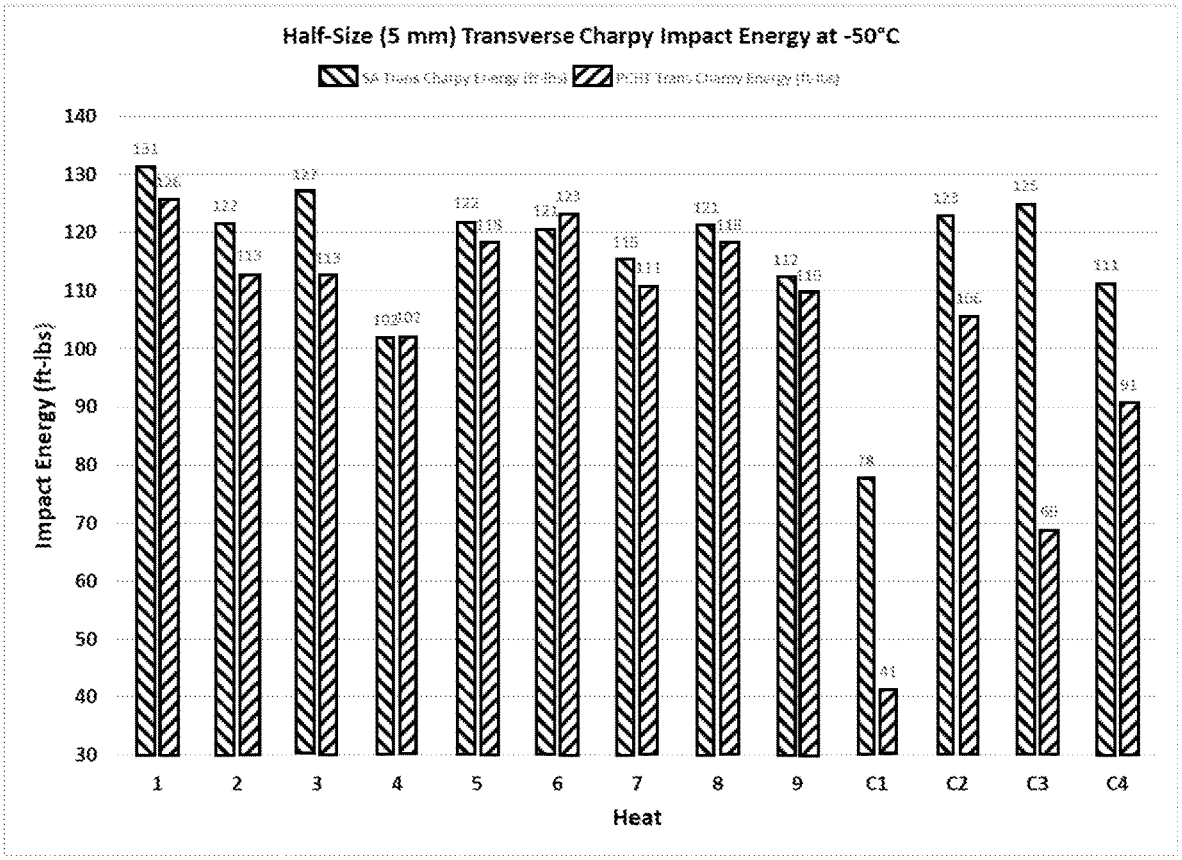
FIG. 17 is a graph of transverse Charpy impact energies for various nickel-based alloys of the present invention in comparison with comparative alloys, both without PCHT and with PCHT, indicating less reduction in the impact strengths of the present alloys following PCHT in comparison with certain comparative alloys.
Figure 18:
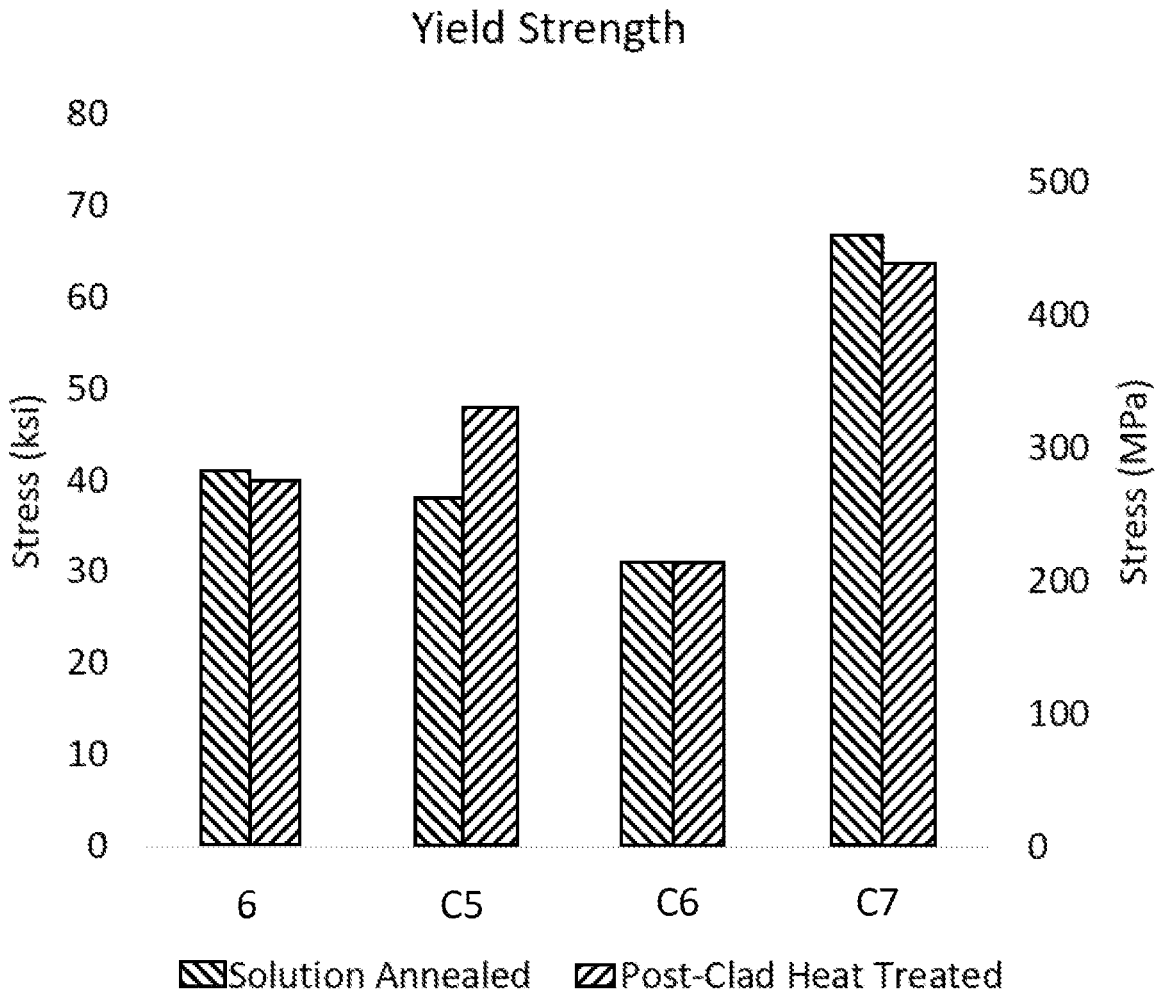
FIG. 18 graphically illustrates yield strengths of a nickel-based alloy of the present invention in comparison with three comparative alloys in solution annealed and PCHT conditions.
Figure 19:
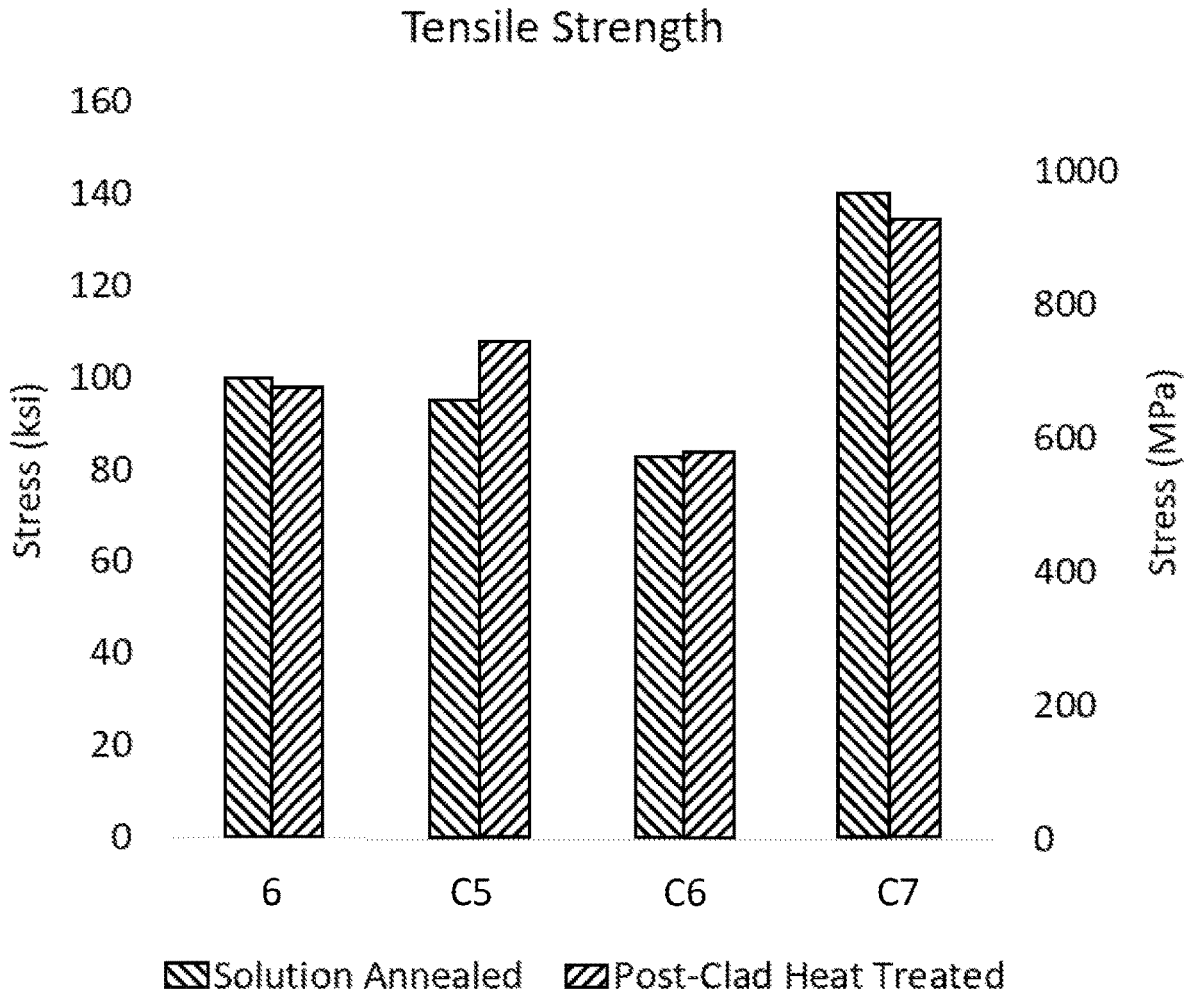
FIG. 19 graphically illustrates tensile strengths of a nickel-based alloy of the present invention in comparison with three comparative alloys in solution annealed and PCHT conditions.
Figure 20:
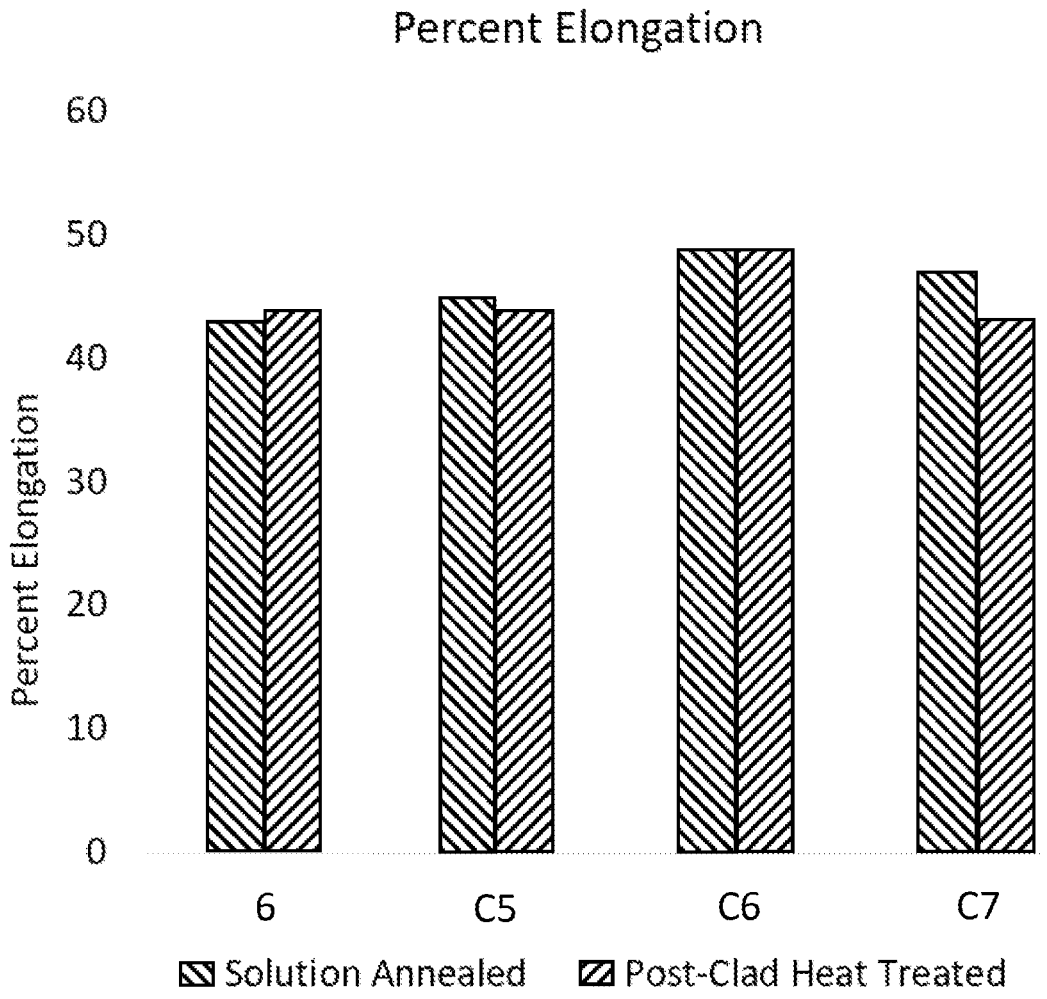
FIG. 20 graphically illustrates percent elongations of a nickel-based alloy of the present invention in comparison with three comparative alloys in solution annealed and PCHT conditions.
Figure 21:
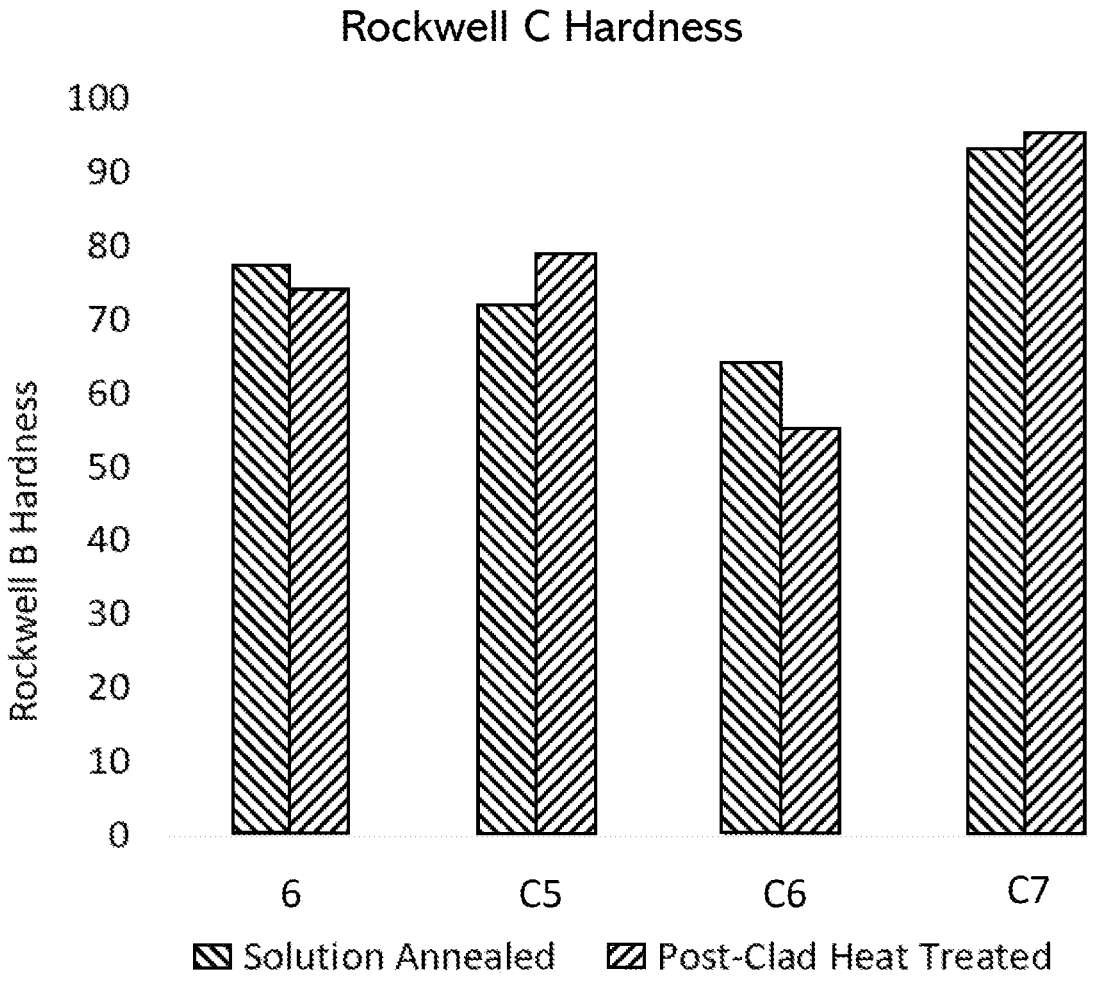
FIG. 21 graphically illustrates Rockwell C hardnesses of a nickel-based alloy of the present invention in comparison with three comparative alloys in solution annealed and PCHT conditions.

FIGS. 16 and 17 are, respectively, graphs of longitudinal and transverse Charpy impact energies measured per ASTM E23-18 at −50° C. in tests of 5-mm thick V-notch impact test specimens of the nickel-based alloys of the present invention in comparison with conventional alloys, both with and without PCHT. The results indicate improved impact strengths of the present alloys that were subjected to PCHT in comparison with the conventional alloys. It can be seen in the figures that the impact energies of most of the alloys decrease following PCHT. However, the amount by which the impact energy decreases in the inventive alloys (ranging from 4.8% to 13.5% in the longitudinal direction and from 2.4% to 11.3% in the transverse direction, relative to the hot-rolling direction) is substantially less than for the comparative alloys (ranging from 18.8% to 51.2% in the longitudinal direction and from 14.1% to 46.8% in the transverse direction, relative to the hot-rolling direction). In other words, the inventive alloys retained 86.5% to 95.2% of their initial toughness in the longitudinal direction, whereas the comparative alloys retained only 48.8% to 81.2% of their initial toughness in the longitudinal direction; and the inventive alloys retained 88.7% to 97.6% of their initial toughness in the transverse direction, whereas the comparative alloys retained only 53.2% to 85.9% of their initial toughness in the transverse direction. In fact, for two of the inventive alloys with elevated Co content (Heats 4 and 7) the longitudinal impact energy is unexpectedly higher than it was in the solution annealed condition.

Example 2

The Heat 6 alloy described above was compared with comparative alloys C5, C6 and C7. Heat C5 had a similar composition as Heat C3 described above, nominally comprising 6 wt. % Mo; Heat C6 had a similar composition as Heat C2 described above corresponding to conventional Alloy 825; and Heat C7 had a similar composition as Heat C1 described above corresponding to conventional Alloy 625. In addition, a nickel-based alloy of the present invention similar to Heat 6 described above was made and designated as Heat 10, which is also listed in Table 2. The composition of Heat 10 was 43.48 Ni, 22.00 Cr, 24.95 Fe, 5.72 Mo, 0.17 Mn, 0.40 Si, 0.97 Cu, 0.05 N, 0.066 W, 2.00 Co, 0.001 Ti, 0.0007 B, 0.006 P, 0.0002 S, 0.093 Nb, 0.060 Al, 0.006 C, and 0.029 V (wt. %). Heat 10 had a PREN of 41.7, an N, of 2.260, and Metal-d of 0.862.

In this Example, cold rolled and annealed 0.060" (1.5 mm) sheets were used for all testing except for the Charpy impact testing, which used hot rolled and annealed 0.270" (6.85 mm) plates. All material was solution annealed (SA) at 2100° F. (1150° C.) after hot and cold rolling for times commensurate with thickness. Some of the material was also given a simulated post clad heat treatment (PCHT) which consisted of one stage at 1750° F. (954° C.) followed by a second stage at 1100° F. (593° C.). Testing was performed on samples in both the SA and PCHT conditions.

Charpy impact testing was performed per ASTM (American Society for Testing and Materials (ASTM) International, 100 Barr Harbor Drive, West Conshohocken, Pa., 19428) E23 (latest revision, "Standard Test Methods for Notched Bar Impact Testing of Metallic Materials" (West Conshohocken, Pa.: ASTM)). Half-size (0.197" [5 mm]) Charpy samples were machined from 0.270" plates and tested at −58° F. (−50° C.). Two samples were tested for each alloy in both the solution annealed and PCHT conditions. Samples were made in the transverse (T-L) orientation. Following the tests, absorbed impact energy, lateral expansion, and percent shear fracture were reported.

Tensile testing was performed at room temperature according to ASTM E8 (latest revision), "Standard Test Methods for Tension Testing of Metallic Materials" (West Conshohocken, Pa.: ASTM)). Standard 2" (50.8 mm) gage length tensile samples were made from 0.060" (1.5 mm) material in the longitudinal direction. Triplicate samples were tested for each alloy in each condition, and the 0.2% offset yield strength, ultimate tensile strength, and the % elongation were determined.

The critical pitting temperature (CPT) for each alloy was measured by testing coupons per ASTM G48 ((latest revision), "Standard Test Methods for Pitting and Crevice Corrosion Resistance of Stainless Steels and Related Alloys by Use of Ferric Chloride Solution" (West Conshohocken, Pa.: ASTM)) Method C. Test coupons approximately 1"×2" (25 mm×50 mm) were sheared from 0.060" sheets. Sheared edges were ground and deburred, finishing with a 240 grit paper. Coupons were cleaned in distilled water and acetone and duplicate coupons were tested at each temperature. Coupons were immersed in an acidified ferric chloride solution and the test was repeated after increasing the solution temperature in increments of 5° C. (9° F.) until the CPT was reached. The CPT is defined as the lowest temperature at which pits are formed that are 0.001" (0.025 mm) or greater in depth.

Intergranular corrosion resistance was measured using ASTM G28 (latest revision), "Standard Test Methods for Detecting Susceptibility to Intergranular Corrosion in Wrought, Nickel-Rich, Chromium-Bearing Alloys" (West Conshohocken, Pa.: ASTM)) Method A. Duplicate test coupons approximately 1"×2" (25 mm×50 mm) were sheared from 0.060" sheets. Sheared edges were ground and deburred, finishing with a 240 grit paper. Coupons were cleaned in distilled water and acetone and immersed in the boiling ferric sulfate-sulfuric acid solution. Tests were run for 120 hours and the weight loss of each coupon was determined.

Stress corrosion cracking resistance was determined in a boiling magnesium chloride solution per ASTM G36 (latest revision), "Standard Practice for Evaluating Stress-Corrosion-Cracking Resistance of Metals and Alloys in a Boiling Magnesium Chloride Solution" (West Conshohocken, Pa.: ASTM)). Duplicate 1"×4" (25.4×101.6 mm) test samples were sheared from 0.060" (1.5 mm) sheets of each alloy. The sheared edges were ground and deburred, finishing with a 240 grit paper. Two holes were drilled 0.5" (12.7 mm) from each end, then the samples were immersed in a solution of 20% $HNO_3$ at 130° F. (54° C.) for ten minutes to remove contaminants then rinsed in distilled water. The samples were then bent around a 1" (25.4 mm) diameter to form a U-shape, which creates a stress state similar to that commonly experienced in the field as a result of equipment manufacturing (welding, forming), installation, and operation (temperature gradients). The ends of the U-bend sample were then bolted to maintain a leg separation of 1" (25.4 mm), using plastic washers to insulate the sample from the bolt. The assembly was ultrasonically cleaned prior to being immersed in 155° C. (311° F.) boiling 45% $MgCl_2$. The U-bend samples were checked periodically for the presence of cracks, and the tests were run until cracks appeared or until the immersion time reached 1,008 hours.

Several 11" (279 mm) bead-on-plate welds were made on 0.060" (1.5 mm) the Heat 6 alloy sheet material using alloy 625 filler metal: specifically, ERNiCrMo-3, 3/32" (2.4 mm) weld wire. Welds were made by a gas tungsten arc welding (GTAW) process. Argon was used for the shielding and backing gas. Power settings used were 70 amps and 10.5 volts. To check weld integrity, welded samples were bent 180° around a 1.5" (38 mm) diameter die with the weld face in tension. To study the weld microstructure, a cross-section of the weld was mounted, polished, and etched using a mixed acids etchant.

The results of mechanical and corrosion testing on the Heat 6 alloy are summarized and compared with those of similar tests conducted on the Heat C5, Heat C6 and Heat C7 alloys (N08367).

Table 3 shows the results of tensile tests performed on 0.060" (1.5 mm) material in both the solution annealed and PCHT conditions. The mechanical property test results are graphically shown in FIGS. 18-21. The 2100° F. (1150° C.) solution anneal temperature was chosen to assure a full solution treatment for all of the alloys tested. This resulted in lower strengths than would typically be obtained for these alloys when annealed at lower temperatures. It is significant that the tensile properties of the Heat 6 alloy and the Heat C6 Alloy do not change appreciably following the PCHT. However, the strength of the Heat C5 alloy increases substantially. This is likely due to the precipitation of undesirable intermetallic phases during the PCHT.

TABLE 3

Tensile Properties of Heat 6 and Comparative Heats C5-C7 in Solution Annealed and Post-Clad Heat Treated Conditions

| | Heat # | | | | | | | |
|---|---|---|---|---|---|---|---|---|
| | 6 | | C5 | | C6 | | C7 | |
| Condition | SA | PCHT | SA | PCHT | SA | PCHT | SA | PCHT |
| Yield Strength ksi (MPa) | 41 (283) | 40 (276) | 38 (262) | 48 (331) | 31 (214) | 31 (214) | 50 (345) | — |
| Tensile Strength ksi (MPa) | 100 (689) | 98 (676) | 95 (655) | 108 (745) | 83 (572) | 84 (579) | 120 (827) | — |
| Percent Elongation | 43 | 44 | 45 | 44 | 49 | 49 | 50 | — |
| Rockwell B Hardness | 77 | 74 | 72 | 79 | 64 | 55 | 84 | — |

Figure 22:
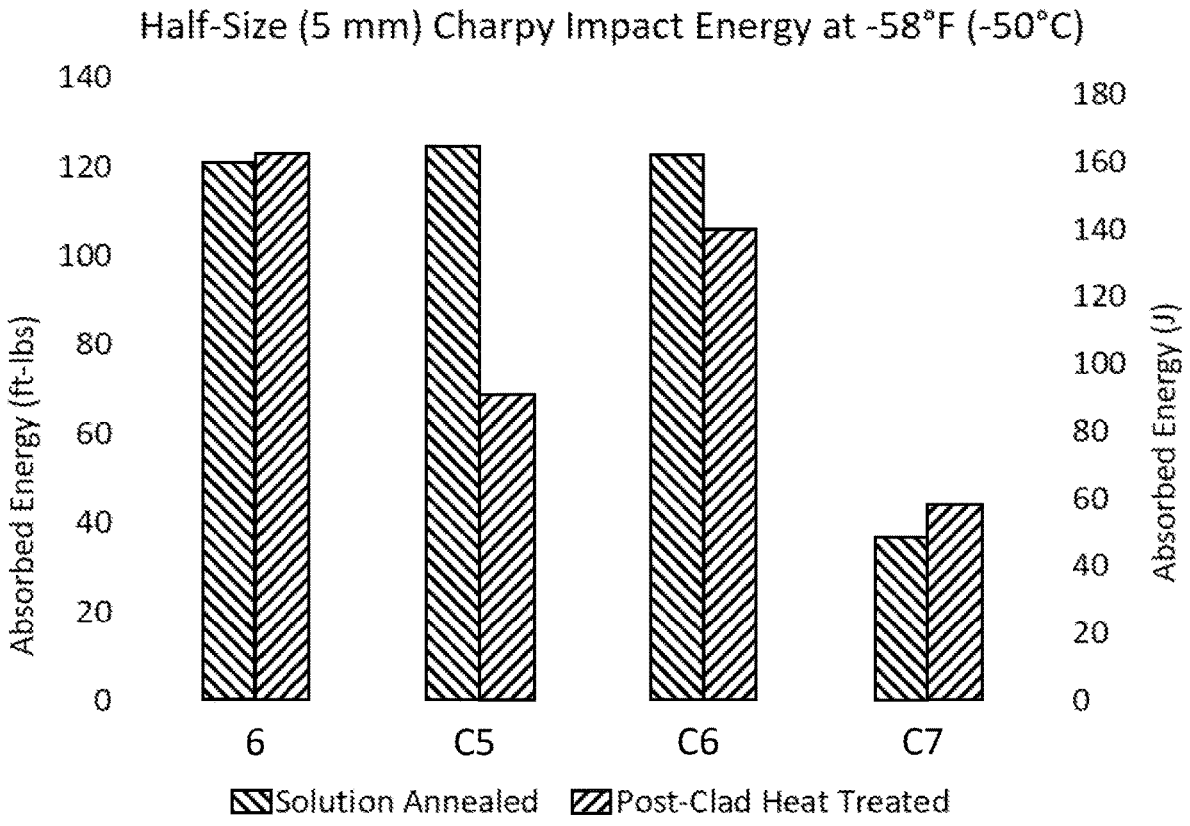
FIG. 22 Charpy graphically illustrates Charpy impact energies of a nickel-based alloy of the present invention in comparison with three comparative alloys in solution annealed and PCHT conditions.

Table 4 shows results of Charpy impact tests performed at −58° F. (−50° C.) on 0.197" (5 mm) samples that were made in the transverse (T-L) orientation. The Charpy impact energy test results are graphically shown in FIG. 22. Samples were tested following a 2100° F. (1150° C.) solution anneal and following a two-stage PCHT at 1750° F. (954° C.) and 1100° F. (593° C.). The data show that all samples had a 100% shear fracture surface with no area of cleavage fracture. The lateral expansion of all of the fractured samples was also fairly high and was in the range of 39 to 60 mils (1.0 to 1.5 mm). However, there were significant differences noted between the alloys in terms of the absorbed energy.

TABLE 4

Half-Size Charpy Impact Test Results for Heat 6 and Comparative Heats C5-C7 Tested at −58° F. (−50° C.) in Solution Annealed and Post-Clad Heat Treated Conditions

| | Heat # | | | | | | | |
|---|---|---|---|---|---|---|---|---|
| | 6 | | C5 | | C6 | | C7 | |
| Condition | SA | PCHT | SA | PCHT | SA | PCHT | SA | PCHT |
| Absorbed Energy ft-lbs (J) | 121 (164) | 123 (167) | 125 (169) | 69 (94) | 123 (167) | 106 (144) | 37 (50) | 44 (59) |
| Lateral Expansion mils (mm) | 51 (1.3) | 51 (1.3) | 60 (1.5) | 55 (1.4) | 53 (1.3) | 50 (1.3) | 39 (1.0) | 40 (1.0) |
| Percent Shear | 100 | 100 | 100 | 100 | 100 | 100 | 100 | 100 |

In the solution annealed condition, Heat 6, Heat C6 (alloy 825), and Heat C5 (6 Mo alloy) all absorbed similar amounts of energy, while Heat C7 (alloy 625) absorbed a lower amount. Following the PCHT, the amount of energy absorbed by the Heat 6 alloy and the Heat 7 alloy was virtually unchanged, while the amount of energy absorbed by the other alloys dropped significantly. The difference in behavior can be explained by the enhanced phase stability of the Heat 6 alloy. The precipitation of deleterious phases during PCHT acts to embrittle some of the alloys, which reduces the amount of energy absorbed during fracture.

To support the Charpy impact test results and confirm the presence of deleterious phases in some of the reference alloys, metallography was performed on cross-sections of the fractured impact test samples. Metallographic specimens were mounted, polished, and electrolytically etched for 90 seconds in oxalic acid at a potential of 6V. FIG. 1 shows a comparison of the microstructures of the Heat 6 alloy and the Heat C5 alloy in both the solution annealed and PCHT conditions. While a few particles can be seen in the Heat 6 alloy microstructure, there is little or no precipitation at the grain boundaries and there is no significant change following the PCHT.

The stability of the Heat 6 alloy microstructure stands in contrast to that of the Heat C5 alloy, which shows lightly-etched grain boundaries in the solution annealed condition but displays heavily-etched boundaries in the PCHT condition. This indicates that the microstructure of the Heat C5 alloy was not stable during the PCHT. The precipitation of deleterious phases at the grain boundaries explains the results of the Charpy tests, in which the absorbed energy of the Heat C5 alloy dropped from 125 ft-lbs (169 J) to 69 ft-lbs (94 J). It may also explain the increase in tensile strength following PCHT that was shown in Table 2.

Figure 23:
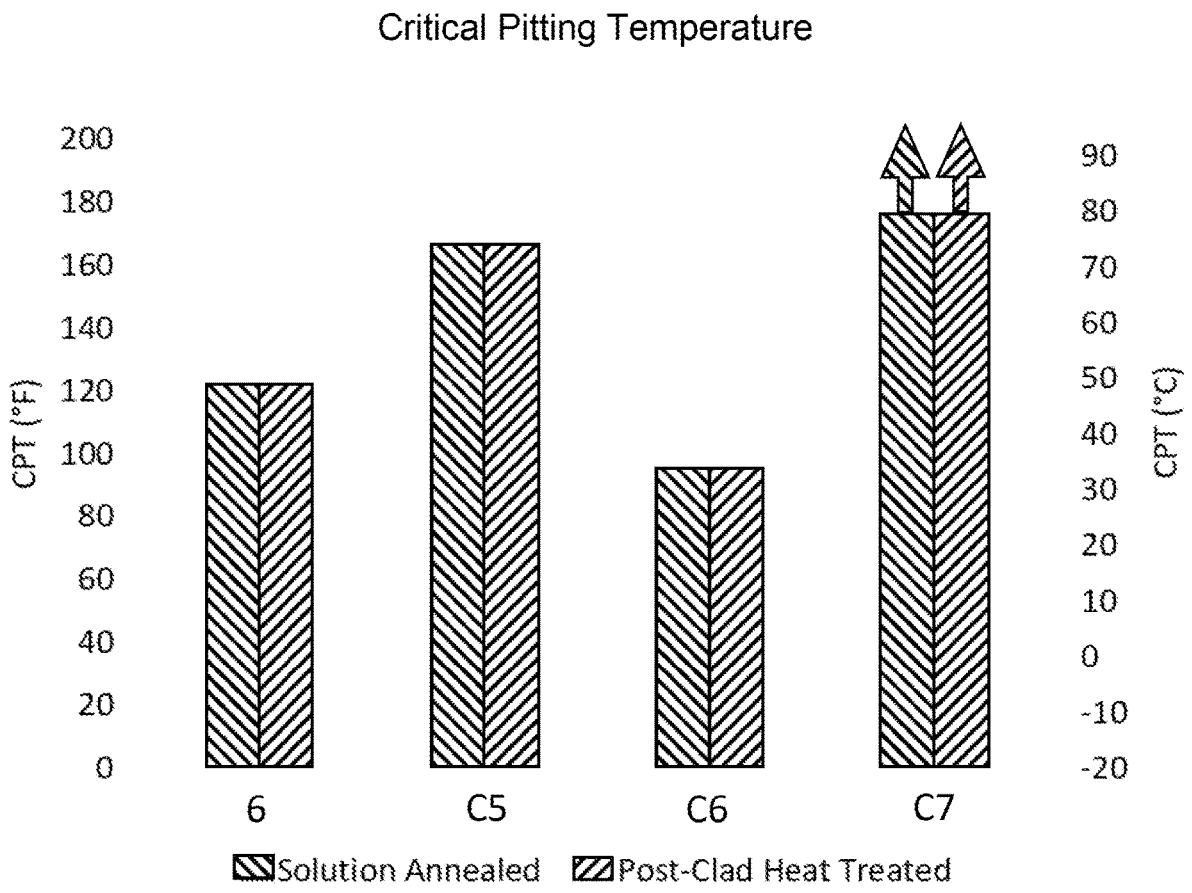
FIG. 23 graphically illustrates critical pitting temperatures of a nickel-based alloy of the present invention in comparison with three comparative alloys in solution annealed and PCHT conditions.

Table 5 shows the critical pitting temperatures measured for the Heat 6 alloy and the other alloys in solution annealed and PCHT conditions according to ASTM G48 Method C. The critical pitting temperature results are graphically shown in FIG. 23.

TABLE 5

Critical Pitting Temperatures Determined per ASTM G48 Method C for samples in the Solution Annealed and Post-Clad Heat Treated Conditions

| | Heat # | | | | | | | |
|---|---|---|---|---|---|---|---|---|
| | 6 | | C5 | | C6 | | C7 | |
| Condition | SA | PCHT | SA | PCHT | SA | PCHT | SA | PCHT |
| CPT ° F. (° C.) | 122 (50) | 122 (50) | 167 (75) | 167 (75) | 95 (35) | 95 (35) | >176 (>80) | >176 (>80) |

The results scale with the PREN numbers of the alloys. The Heat C7 had the highest CPT among the alloys tested due to its high Mo content, which is generally considered excessive for most aqueous environments. The Heat C7 alloy did not pit when tested at 80° C. (176° F.), so it has a CPT that is at least 85° C. (185° F.). Testing was not conducted above this temperature because the test procedure of ASTM G48 Method C states that 85° C. (185° F.) is the maximum temperature for this test. The Heat C5 alloy has the second highest PREN and also had the second highest CPT of 75° C. (167° F.). The Heat 6 alloy had a CPT of 50° C. (122° F.), which is significantly greater than the CPT of the Heat C6 alloy, 35° C. (95° F.).

It was unexpected that the PCHT did not reduce the CPT of the Heat C5 alloy, or any of the others, even though it caused the precipitation of deleterious phases as seen in FIGS. 4 and 5. This may be due to the absence of a Cr-depleted zone near these precipitates. It is possible that the two-stage PCHT allows for the back-diffusion of Cr after the precipitates form, which restores corrosion resistance even though mechanical properties are clearly degraded by the grain boundary precipitates.

Figure 24:
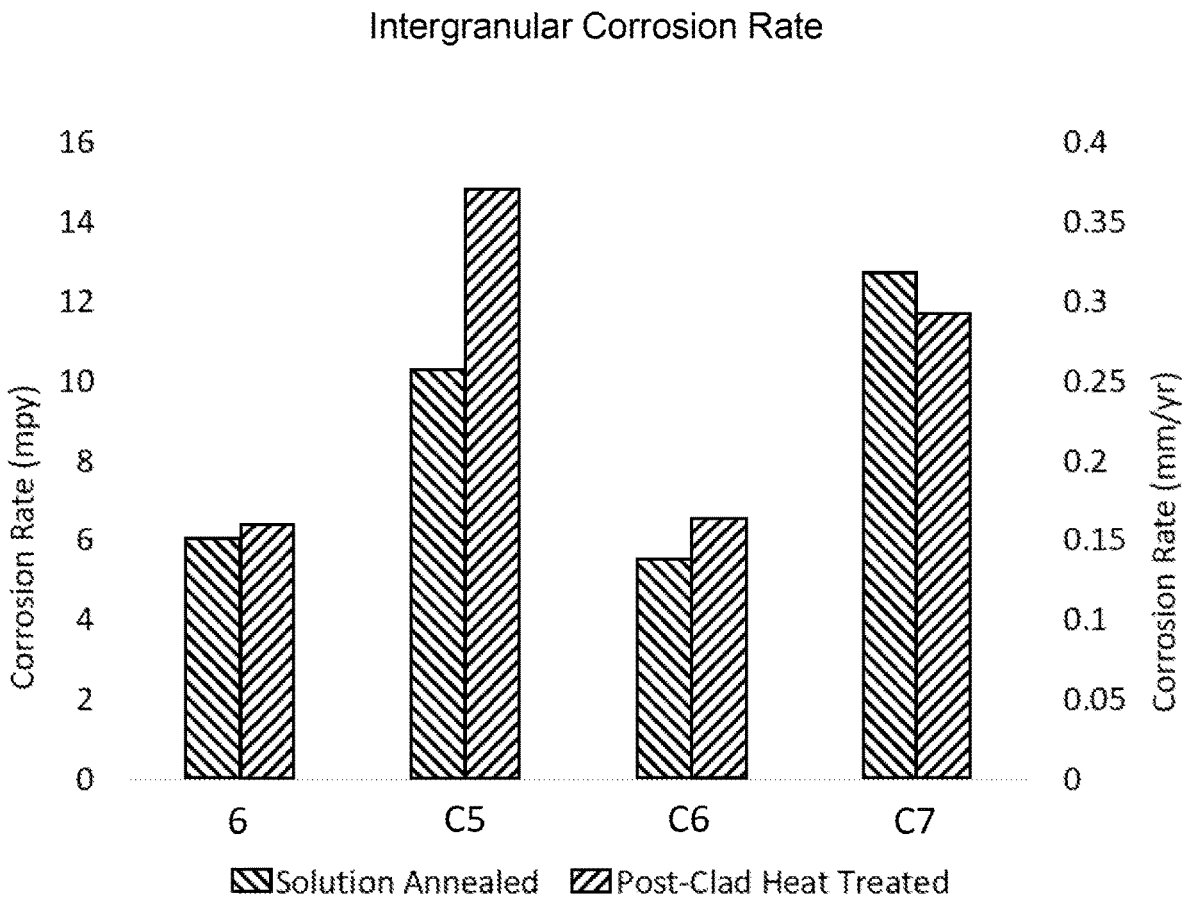
FIG. 24 graphically illustrates intergranular corrosion rates of a nickel-based alloy of the present invention in comparison with three comparative alloys in solution annealed and PCHT conditions.

Table 6 shows the intergranular corrosion rates measured for the Heat 6 alloy and the other alloys according to ASTM G28 Method A. The intergranular corrosion rates are graphically shown in FIG. 24. Rates are shown in both mils per year and mm per year.

TABLE 6

Intergranular Corrosion Rates Determined per ASTM G28 Method A for samples in the Solution Annealed and Post-Clad Heat Treated Conditions

| | Heat # | | | | | | | |
|---|---|---|---|---|---|---|---|---|
| | 6 | | C5 | | C6 | | C7 | |
| Condition | SA | PCHT | SA | PCHT | SA | PCHT | SA | PCHT |
| Corrosion Rate mm/yr (mpy) | 0.153 (6.03) | 0.163 (6.42) | 0.261 (10.29) | 0.376 (14.80) | 0.139 (5.49) | 0.166 (6.54) | 0.324 (12.76) | 0.297 (11.68) |

All of the alloys tested had fairly low corrosion rates in the solution-annealed condition. The Heat 6 and Heat C6 alloys had the lowest rates, while the rates for the Heat C5 and Heat C7 alloys were slightly higher. A common acceptance criterion used for alloy 625 (Heat C7) in this test is a corrosion rate less than 0.625 mm/yr (24.6 mpy), and all of the alloys tested easily met that requirement in the solution-annealed condition. The corrosion rates of most of the alloys in this test increased following the PCHT. The corrosion rate was 6.5% higher for the Heat 6 alloy, 19.4% higher for the Heat C6 alloy, and 44.1% higher for the Heat C5 alloy. The rate was 8.3% lower for the Heat C7 alloy. Except for the Heat C5 alloy, all of these differences are small, and even that alloy had a corrosion rate well below the targeted limit of less than 0.625 mm/yr (24.6 mpy).

Figure 25:
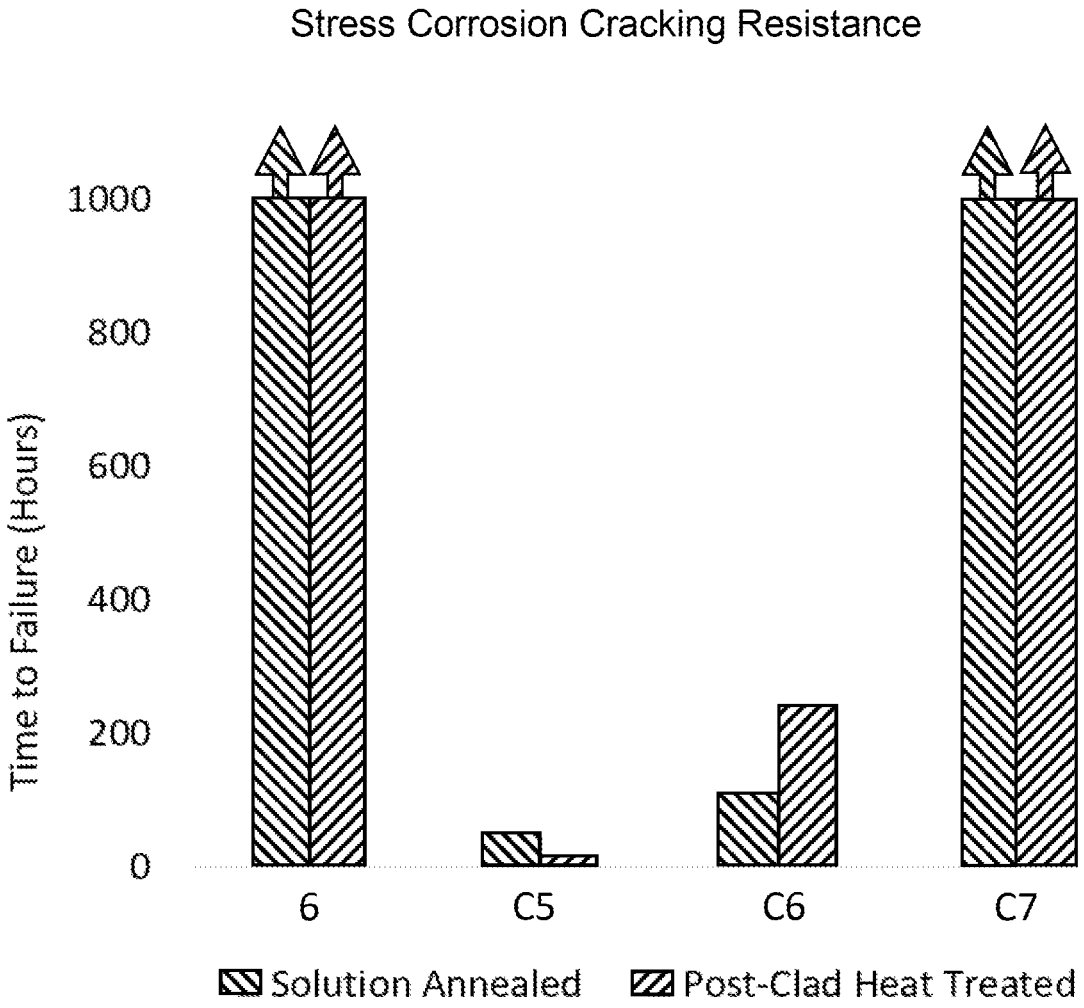
FIG. 25 graphically illustrates stress corrosion cracking resistances of a nickel-based alloy of the present invention in comparison with three comparative alloys in solution annealed and PCHT conditions.

Table 7 shows the time to SCC failure measured on duplicate samples of the Heat 6 alloy and the other alloys when tested according to ASTM G36. The stress corrosion cracking results are graphically shown in FIG. 25.

TABLE 7

Hours to failure of Stress Corrosion Cracking Samples Tested in a Boiling $MgCl_2$ Solution per ASTM G36 in the Solution Annealed and Post-Clad Heat Treated Conditions.

| | Heat # | | | | | | | |
|---|---|---|---|---|---|---|---|---|
| | 6 | | C5 | | C6 | | C7 | |
| Condition | SA | PCHT | SA | PCHT | SA | PCHT | SA | PCHT |
| Sample 1 (hours) | >1000 | >1000 | 50 | 15 | 110 | 240 | >1000 | >1000 |
| Sample 2 (hours) | >1000 | >1000 | 50 | 15 | 95 | 190 | >1000 | >1000 |

This test is significant in discerning an alloy's expected field performance under stresses from equipment manufacturing, installation, and operation. Tests were discontinued if no cracking had been observed after 1,008 hours. The data show that both of the Heat 6 and Heat C7 alloys passed the test with no cracking observed. Since alloy 625 (Heat 7) contains 63% Ni, it was expected to perform well in this test. It was shown by Copson (H. R. Copson, "Effect of Composition on Stress Corrosion Cracking of Some Alloys Containing Nickel," Physical Metallurgy of Stress Corrosion Fracture, Interscience Publishers, New York, 1959) that susceptibility to chloride stress corrosion cracking is related to Ni content. For the alloys shown in Table 6, the time to failure increased with increasing Ni content. From these results it can be concluded that the Heat 6 alloy has sufficient Ni content to resist SCC under stress in a 155° C. (311° F.) boiling, high-chloride environment better than alloy 825 (Heat C6) or superaustenitic stainless steels. It is also important to note that the SCC resistance does not appear to be significantly diminished by the PCHT, except for in the Heat C5 alloy. The loss of resistance in that alloy is likely because of the heavy precipitation of detrimental phases that occurred in that alloy during the PCHT, as was shown in FIGS. 4 and 5.

Figure 26:
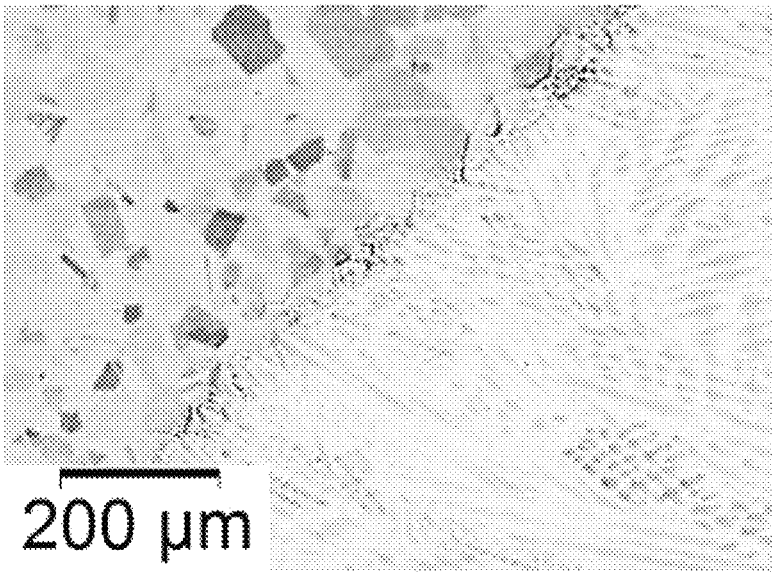
FIG. 26 is an optical micrograph of a weld zone of a nickel-based alloy of the present invention.
Figure 27:
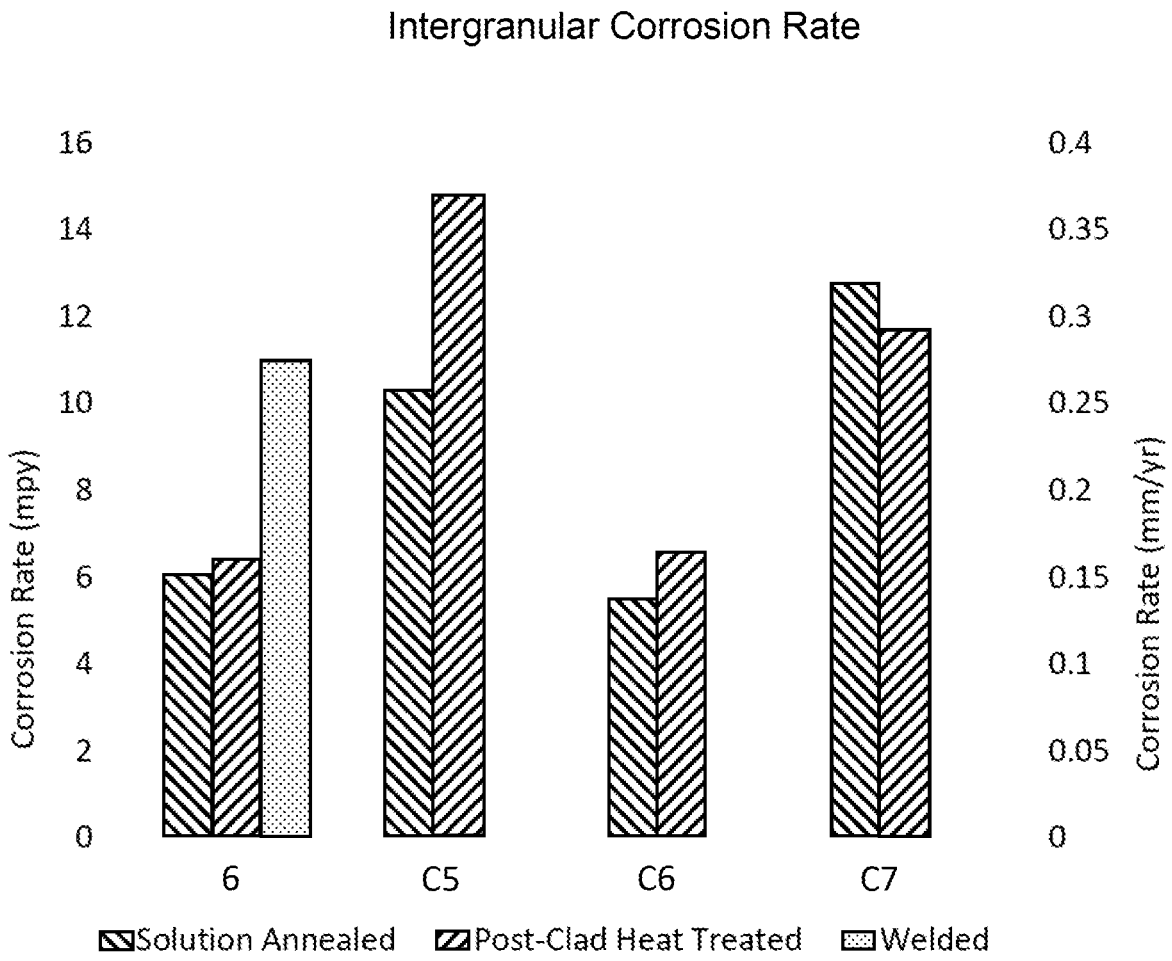
FIG. 27 graphically illustrates intergranular corrosion rates of a nickel-based alloy of the present invention in comparison with three comparative alloys in solution annealed and PCHT conditions. The intergranular corrosion rate of a weld of the nickel-based alloy of the present invention is also shown.

Samples of the Heat 6 alloy were GTAW welded using alloy 625 filler metal. An optical micrograph of the weld zone is shown in FIG. 26 at a magnification of approximately 100×. To check weld integrity, welded samples were bent 180° around a 1.5" (38 mm) diameter die with the weld face in tension. To study the weld microstructure, a cross-section of the weld was mounted, polished, and etched using a mixed acids etchant. The as-welded microstructure of the weld-base metal interface shown in FIG. 26 includes a small mixed region at the interface, but little evidence of deleterious phase precipitation is seen in the area adjacent to the weld. The weld-face bend tests demonstrated good ductility with no visible cracking observed.

The Heat 6 alloys and other alloys of the present invention have very stable microstructures that resist formation of deleterious phases when exposed to sensitizing heat treatments, such as those applied to hot-roll bonded pipe after cladding. As a result, very little change occurs to mechanical properties, particularly impact toughness, following the simulated PCHT.

The corrosion resistance of the nickel-based alloys of the present invention changes very little following the PCHT, which was not the case for other alloys tested, especially the Heat C5 alloy. With a PREN of 42 and a CPT of 50° C. (122° F.), the Heat 6 alloy has better resistance than alloy 825 (Heat C6) to pitting in chloride-containing environments such as seawater. The Heat 6 alloy surpassed 1,000 hours in a boiling $MgCl_2$ solution without cracking, which exceeded the performance of alloy 825 (Heat C6), and the Heat C5 alloy in the same test. The Heat 6 alloy displayed good resistance to intergranular corrosion, even after a sensitizing heat treatment.

Sheets of the Heat 6 alloy were successfully welded using alloy 625 filler metal. Welded samples passed a bend test without cracking and the microstructure of the weld and the adjacent heat-affected zone looked sound.

The combined results of these tests indicate that the nickel-based alloys of the present invention including the Heat 6 alloy provide cost-saving replacements for alloy 625 in severely corrosive environments, such as are found in oil and gas and chemical processing applications. The nickel-based alloys of the present invention provide improvements over alloy 825 in applications where additional corrosion resistance is needed.

Aspects of the Invention

Various aspects of the invention include, but are not limited to, the following numbered clauses.

1. A nickel-based alloy comprising from 38 to 60 weight percent Ni, from 19 to 25 weight percent Cr, from 15 to 35 weight percent Fe, from 3 to 7 weight percent Mo, and from 0.1 to 10 weight percent Co.
2. The nickel-based alloy of clause 1, wherein the Ni comprises from 39 to 50 weight percent, the Cr comprises from 20 to 25 weight percent, the Fe comprises from 15 to 30 weight percent, the Mo comprises from 3.5 to 6.5 weight percent, and the Co comprises from 0.2 to 4 weight percent.
3. The nickel-based alloy of clause 1 or clause 2, wherein the Ni comprises from 40 to 48 weight percent, the Cr comprises from 21 to 25 weight percent, the Fe comprises from 16 to 29 weight percent, the Mo comprises from 4 to 6.5 weight percent, and the Co comprises from 0.25 to 2.6 weight percent.
4. The nickel-based alloy of any one of clauses 1-3, further comprising from 0.1 to 4 weight percent Cu, and from 0.1 to 3 weight percent Mn.
5. The nickel-based alloy of any one of clauses 1-4, further comprising less than 0.15 weight percent N, less than 1.0 weight percent Si, from 0.01 to 0.1 weight percent Ti, from 0.01 to 0.2 weight percent Nb, from 0.02 to 0.3 weight percent Al, and from 0.0002 to 0.005 weight percent B.
6. The nickel-based alloy of any one of clauses 1-4, further comprising, from 0.2 to 3 weight percent Cu, and from 0.2 to 2.5 weight percent Mn.
7. The nickel-based alloy of any one of clauses 1-6, further comprising less than 0.15 weight percent N, less than 1.0 weight percent Si, from 0.01 to 0.08 weight percent Ti, from 0.02 to 0.15 weight percent Nb, from 0.04 to 0.25 weight percent Al, and from 0.0004 to 0.0035 weight percent B.
8. The nickel-based alloy of any one of clauses 1-4, further comprising from 0.25 to 2 weight percent Cu, and from 0.25 to 2 weight percent Mn.
9. The nickel-based alloy of any one of clauses 1-8, further comprising less than 0.15 weight percent N, less than 1.0 weight percent Si, from 0.01 to 0.07 weight percent Ti, from 0.02 to 0.1 weight percent Nb, from 0.06 to 0.25 weight percent Al, and from 0.0010 to 0.0030 weight percent B.
10. The nickel-based alloy of any one of clauses 1-9, wherein the nickel-based alloy comprises less than 0.01 weight percent Mg.
11. The nickel-based alloy of any one of clauses 1-10, wherein the nickel-based alloy further comprises from 0.01 to 0.1 weight percent Ti.
12. The nickel-based alloy of any one of clauses 1-11, wherein the nickel-based alloy comprises less than 0.3 weight percent V.
13. The nickel-based alloy of any one of clauses 1-12, wherein the nickel-based alloy comprises less than 0.3 weight percent W.
14. The nickel-based alloy of any one of clauses 1-13, wherein the nickel-based alloy contains less than or equal to 0.010 weight percent C.
15. The nickel-based alloy of any one of clauses 1-14, wherein the nickel-based alloy has a PREN of at least 40.
16. The nickel-based alloy of any one of clauses 1-15, wherein the nickel-based alloy has a PREN of from 40 to 45.
17. The nickel-based alloy of any one of clauses 1-16 and 18-20, wherein the nickel-based alloy has a Charpy impact energy of at least 100 ft-lbs, measured using 5-millimeter specimens at −50° C. per ASTM E23-18.
18. The nickel-based alloy of any one of clauses 1-17, 19 and 20, wherein the nickel-based alloy has a critical pitting temperature of greater than 95° F., measured per ASTM G48 Method C.
19. The nickel-based alloy of any one of clauses 1-18 and 20, wherein the nickel-based alloy has an intergranular corrosion rate of less than 0.25 mm/yr, measured per ASTM G28 Method A.
20. The nickel-based alloy of any one of clauses 1-19, wherein the nickel-based alloy has a resistance to stress corrosion cracking of greater than 1,000 hrs, measured per ASTM G36.
21. The nickel-based alloy of any one of clauses 1-20, wherein the nickel-based alloy is subjected to a post-cladding heat treatment.
22. The nickel-based alloy of clause 21, wherein the post-cladding heat treated nickel-based alloy has a sigma solvus of less than 2,000° F.
23. The nickel-based alloy of clause 22, wherein the sigma solvus is from 1,846 to 1,996° F.
24. The nickel-based alloy of any one of clauses 21-23, wherein the post-cladding heat treated nickel-based alloy has a Nv of less than 2.4.
25. The nickel-based alloy of clause 24, wherein the Nv is from 2.154 to 2.331.
26. The nickel-based alloy of any one of clauses 21-25, wherein the post-cladding heat treated nickel-based alloy has a Metal d of less than 0.87.
27. The nickel-based alloy of clause 26, wherein the Metal d is from 0.852 to 0.865.
28. The nickel-based alloy of any one of clauses 21-27, wherein the post-cladding heat treated nickel-based alloy has a Charpy impact energy of at least 100 ft-lbs, measured using 5-millimeter specimens at −50° C. per ASTM E23-18.
29. The nickel-based alloy of clause 28, wherein the Charpy impact energy is at least 110 ft-lbs.
30. The nickel-based alloy of any one of clauses 1-29, wherein the nickel-based alloy has a Charpy impact energy, in a post-cladding heat-treated condition, that is at least 85% of the Charpy impact energy of the alloy in a solution-annealed condition.
31. The nickel-based alloy of any one of clauses 1-29, wherein the nickel-based alloy has a Charpy impact energy, in a post-cladding heat-treated condition, that is at least 90% of the Charpy impact energy of the alloy in a solution-annealed condition.

32. The nickel-based alloy of any one of clauses 21-31, wherein the nickel-based alloy has a Charpy impact energy in the post-cladding heat-treated condition, that is greater than or equal to a Charpy impact energy of the alloy in a solution-annealed condition, measured using 5-millimeter specimens at −50° C. per ASTM E23-18.

33. The nickel-based alloy of any one of clauses 21-32, 34 and 35, wherein the nickel-based alloy in the post-cladding heat-treated condition has a critical pitting temperature of greater than 95° F., measured per ASTM G48 Method C.

34. The nickel-based alloy of any one of clauses 21-33 and 35, wherein the nickel-based alloy in the post-cladding heat-treated condition has an intergranular corrosion rate of less than 0.25 mm/yr, measured per ASTM G28 Method A.

35. The nickel-based alloy of any one of clauses 21-34, wherein the nickel-based alloy in the post-cladding heat-treated condition has a resistance to stress corrosion cracking of greater than 1,000 hrs, measured per ASTM G36.

36. A method of making a nickel-based alloy comprising from 38 to 60 weight percent Ni, from 19 to 25 weight percent Cr, from 15 to 35 weight percent Fe, from 0.1 to 10 weight percent Co, and from 3 to 7 weight percent Mo, the method comprising:

homogenizing an ingot of the nickel-based alloy;

working the homogenized ingot to form a slab or billet;

further hot rolling to form a plate or bar or tubular product;

annealing the product; and cooling the annealed product.

37. The method of clause 36, further comprising subjecting the product to a post-cladding heat treatment or a welded heat affected zone.

38. The method of clause 37, wherein the post-cladding heat treatment is performed at a temperature of from 1,100 to 1,800° F.

39. The method of clause 37 or clause 38, wherein the post-cladding heat treatment may be performed either at a first temperature and/or with a second temperature lower than the first temperature.

40. The method of any one of clauses 37-39, wherein the post-cladding heat treated product has a sigma solvus of less than 2,000° F.

41. The method of any one of clauses 37-40, wherein the post-cladding heat treated product has a Nv of less than 2.4.

42. The method of any one of clauses 37-41, wherein the post-cladding heat treated product has a Metal d of less than 0.87.

43. The method of any one of clauses 37-42, wherein the post-cladding heat treated product has a Charpy impact energy of at least 100 ft-lbs, measured using 5-millimeter specimens at −50° C. per ASTM E23-18.

44. The method of any one of clauses 37-43, wherein the nickel-based alloy has a Charpy impact energy, in the post-cladding heat-treated condition, that is at least 85% of the Charpy impact energy of the alloy in a solution-annealed condition.

45. The method of any one of clauses 37-44, wherein the nickel-based alloy has a Charpy impact energy, in the post-cladding heat-treated condition, that is at least 90% of the Charpy impact energy of the alloy in a solution-annealed condition.

46. The method of claim any one of clauses 37-45 and 47-49, wherein the nickel-based alloy has a Charpy impact energy in the post-cladding heat-treated condition, that is greater than or equal to a Charpy impact energy of the alloy in a solution-annealed condition, measured using 5-millimeter specimens at −50° C. per ASTM E23-18.

47. The method of any one of clauses 37-46, 48 and 49, wherein the nickel-based alloy in the post-cladding heat-treated condition has a critical pitting temperature of greater than 95° F., measured per ASTM G48 Method C.

48. The method of any one of clauses 37-47 and 49, wherein the nickel-based alloy in the post-cladding heat-treated condition has an intergranular corrosion rate of less than 0.25 mm/yr, measured per ASTM G28 Method A.

49. The method of any one of clauses 37-48, wherein the nickel-based alloy in the post-cladding heat-treated condition has a resistance to stress corrosion cracking of greater than 1,000 hrs, measured per ASTM G36.

Any patent, patent application, publication, or other extrinsic document identified in this specification is incorporated by reference into this specification in its entirety unless otherwise indicated, but only to the extent that the incorporated material does not conflict with descriptions, definitions, statements, illustrations, and the like, expressly set forth in this specification. As such, and to the extent necessary, the express descriptions set forth in this specification supersede any conflicting material incorporated by reference. Any material, or portion thereof, that is incorporated by reference into this specification, but which conflicts with the express descriptions set forth in this specification, is only incorporated to the extent that no conflict arises between that incorporated material and the express descriptions. Applicant reserves the right to amend this specification to expressly recite any subject matter, or portion thereof, incorporated by reference. The amendment of this specification to add such incorporated subject matter will comply with written description and sufficiency of description requirements (e.g., 35 U.S.C. § 112(a) and Article 123(2) EPC).

Various features and characteristics are described in this specification and illustrated in the drawings to provide an overall understanding of the invention. It is understood that the various features and characteristics described in this specification and illustrated in the drawings can be combined in any operable manner regardless of whether such features and characteristics are expressly described or illustrated in combination in this specification. The Inventors and the Applicant expressly intend such combinations of features and characteristics to be included within the scope of this specification, and further intend the claiming of such combinations of features and characteristics to not add new subject matter to the application. As such, the claims can be amended to recite, in any combination, any features and characteristics expressly or inherently described in, or otherwise expressly or inherently supported by, this specification. Furthermore, the Applicant reserves the right to amend the claims to affirmatively disclaim features and characteristics that may be present in the prior art, even if those features and characteristics are not expressly described in this specification. Therefore, any such amendments will not add new subject matter to the specification or claims, and will comply with written description, sufficiency of description, and added matter requirements (e.g., 35 U.S.C. § 112(a) and Article 123(2) EPC). The invention can comprise, consist of, or consist essentially of the various features and characteristics described in this specification. In some cases, the invention can also be substantially free of any component or other feature or characteristic described in this specification.

Also, any numerical range recited in this specification includes the recited endpoints and describes all sub-ranges of the same numerical precision (i.e., having the same number of specified digits) subsumed within the recited range. For example, a recited range of "1.0 to 10.0" describes all sub-ranges between (and including) the recited minimum value of 1.0 and the recited maximum value of 10.0, such as, for example, "2.4 to 7.6," even if the range of "2.4 to 7.6" is not expressly recited in the text of the specification. Accordingly, the Applicant reserves the right to amend this specification, including the claims, to expressly recite any sub-range of the same numerical precision subsumed within the ranges expressly recited in this specification. All such ranges are inherently described in this specification such that amending to expressly recite any such sub-ranges will comply with written description, sufficiency of description, and added matter requirements (e.g., 35 U.S.C. § 112(a) and Article 123(2) EPC).

As used herein, "including," "containing," and like terms are understood in the context of this specification to be synonymous with "comprising" and are therefore open-ended and do not exclude the presence of additional undescribed or unrecited elements, materials, ingredients, or method steps. As used herein, "consisting of" is understood in the context of this specification to exclude the presence of any unspecified element, ingredient, or method step. As used herein, "consisting essentially of" is understood in the context of this specification to include the specified elements, materials, ingredients, or method steps "and those that do not materially affect the basic and novel characteristic(s)" of what is being described. The grammatical articles "one", "a", "an", and "the", as used in this specification, are intended to include "at least one" or "one or more", unless otherwise indicated or required by context. Thus, the articles are used in this specification to refer to one or more than one (i.e., to "at least one") of the grammatical objects of the article. By way of example, "a component" means one or more components, and thus, possibly, more than one component is contemplated and can be employed or used in an implementation of the invention. Further, the use of a singular noun includes the plural, and the use of a plural noun includes the singular, unless the context of the usage requires otherwise.

Whereas specific examples of the invention have been described in detail, it will be appreciated by those skilled in the art that various modifications and alternatives to those details could be implemented in light of the overall teachings of this specification of the invention. Accordingly, the particular implementations described are meant to be illustrative only and not necessarily limiting as to the scope of the invention, as claimed, which is to be given the full breadth of the claims appended and any and all equivalents thereof.

What is claimed is:

1. A nickel-based alloy comprising from 38 to 60 weight percent Ni, from 19 to 25 weight percent Cr, from 15 to 35 weight percent Fe, from 3 to 7 weight percent Mo, and from 0.1 to 10 weight percent Co, wherein the nickel-based alloy possesses at least one of the following properties:

- a Charpy impact energy of at least 100 ft-lbs, measured using 5-millimeter specimens at −50° C. per ASTM E23-18;
- a critical pitting temperature of greater than 95° F., measured per ASTM G48 Method C;
- an intergranular corrosion rate of less than 0.25 mm/yr, measured per ASTM G28 Method A; and
- a resistance to stress corrosion cracking of greater than 1,000 hrs, measured per ASTM G36.

2. The nickel-based alloy of claim 1, wherein the Ni comprises from 39 to 50 weight percent, the Cr comprises from 20 to 25 weight percent, the Fe comprises from 15 to 30 weight percent, the Mo comprises from 3.5 to 6.5 weight percent, and the Co comprises from 0.2 to 4 weight percent.

3. The nickel-based alloy of claim 1, wherein the Ni comprises from 40 to 48 weight percent, the Cr comprises from 21 to 25 weight percent, the Fe comprises from 16 to 29 weight percent, the Mo comprises from 4 to 6.5 weight percent, and the Co comprises from 0.25 to 2.6 weight percent.

4. The nickel-based alloy of claim 1, further comprising from 0.1 to 4 weight percent Cu, and from 0.1 to 3 weight percent Mn.

5. The nickel-based alloy of claim 4, further comprising less than 0.15 weight percent N, less than 1.0 weight percent Si, from 0.01 to 0.1 weight percent Ti, from 0.01 to 0.2 weight percent Nb, from 0.02 to 0.3 weight percent Al, and from 0.0002 to 0.005 weight percent B.

6. The nickel-based alloy of claim 1, wherein the nickel-based alloy comprises less than 0.01 weight percent Mg.

7. The nickel-based alloy of claim 6, wherein the nickel-based alloy further comprises from 0.01 to 0.1 weight percent Ti.

8. The nickel-based alloy of claim 1, wherein the nickel-based alloy comprises less than 0.3 weight percent V.

9. The nickel-based alloy of claim 1, wherein the nickel-based alloy comprises less than 0.3 weight percent W.

10. The nickel-based alloy of claim 1, wherein the nickel-based alloy contains less than or equal to 0.010 weight percent C.

11. The nickel-based alloy of claim 1, wherein the nickel-based alloy has a PREN of at least 40.

12. The nickel-based alloy of claim 1, wherein the nickel-based alloy has a Charpy impact energy of at least 100 ft-lbs, measured using 5-millimeter specimens at −50° C. per ASTM E23-18.

13. The nickel-based alloy of claim 1, wherein the nickel-based alloy has a critical pitting temperature of greater than 95° F., measured per ASTM G48 Method C.

14. The nickel-based alloy of claim 1, wherein the nickel-based alloy has an intergranular corrosion rate of less than 0.25 mm/yr, measured per ASTM G28 Method A.

15. The nickel-based alloy of claim 1, wherein the nickel-based alloy has a resistance to stress corrosion cracking of greater than 1,000 hrs, measured per ASTM G36.

16. The nickel-based alloy of claim 1, wherein the nickel-based alloy is subjected to a post-cladding heat treatment.

17. The nickel-based alloy of claim 16, wherein the post-cladding heat treated nickel-based alloy has a Charpy impact energy of at least 100 ft-lbs, measured using 5-millimeter specimens at −50° C. per ASTM E23-18.

18. The nickel-based alloy of claim 17, wherein the Charpy impact energy is at least 110 ft-lbs.

19. The nickel-based alloy of claim 18, wherein the post-cladding heat treated nickel-based alloy has a Metal d of less than 0.87.

20. The nickel-based alloy of claim 16, wherein the post-cladding heat treated nickel-based alloy has a sigma solvus of less than 2,000° F.

21. The nickel-based alloy of claim 16, wherein the post-cladding heat treated nickel-based alloy has a Nv of less than 2.4.

22. The nickel-based alloy of claim 16, wherein the nickel-based alloy has a Charpy impact energy, in the post-cladding heat-treated condition, that is at least 85% of a Charpy impact energy of the alloy in a solution-annealed condition, measured using 5-millimeter specimens at −50° C. per ASTM E23-18.

23. The nickel-based alloy of claim 16, wherein the nickel-based alloy has a Charpy impact energy, in the post-cladding heat-treated condition, that is at least 90% of a Charpy impact energy of the alloy in a solution-annealed condition, measured using 5-millimeter specimens at −50° C. per ASTM E23-18.

24. The nickel-based alloy of claim 16, wherein the nickel-based alloy has a Charpy impact energy in the post-cladding heat-treated condition, that is greater than or equal to a Charpy impact energy of the alloy in a solution-annealed condition, measured using 5-millimeter specimens at −50° C. per ASTM E23-18.

25. The nickel-based alloy of claim 16, wherein the nickel-based alloy in the post-cladding heat-treated condition has a critical pitting temperature of greater than 95° F., measured per ASTM G48 Method C.

26. The nickel-based alloy of claim 16, wherein the nickel-based alloy in the post-cladding heat-treated condition has an intergranular corrosion rate of less than 0.25 mm/yr, measured per ASTM G28 Method A.

27. The nickel-based alloy of claim 16, wherein the nickel-based alloy in the post-cladding heat-treated condition has a resistance to stress corrosion cracking of greater than 1,000 hrs, measured per ASTM G36.

* * * * *